US005332038A

United States Patent [19]

Tapp et al.

[11] Patent Number: 5,332,038

[45] Date of Patent: Jul. 26, 1994

[54] GRAVEL PACKING SYSTEM

[75] Inventors: Wiliam T. Tapp, Yorktown; Marvin B. Traweek; Richard A. Mollicone, both of Houston, all of Tex.

[73] Assignee: Baker Hughes Incorporated, Houston, Tex.

[21] Appl. No.: 925,173

[22] Filed: Aug. 6, 1992

[51] Int. Cl.[5] ..... E21B 33/124; E21B 43/04

[52] U.S. Cl. ..... 166/278; 166/51; 166/123

[58] Field of Search ..... 166/278, 51, 123, 181, 166/182, 120, 387

[56] References Cited

U.S. PATENT DOCUMENTS

| | | | |
|---|---|---|---|
| 3,710,862 | 1/1973 | Young et al. | 166/51 X |
| 4,372,384 | 2/1983 | Kinney | 166/51 X |
| 4,401,158 | 8/1983 | Spencer et al. | 166/51 |
| 4,660,637 | 4/1987 | McGill et al. | 166/120 |
| 4,796,707 | 1/1989 | Halbardier | 166/123 X |
| 4,842,057 | 6/1989 | Lubitz | 166/123 X |
| 4,858,690 | 8/1989 | Rebardi et al. | 166/51 X |
| 4,862,957 | 9/1989 | Scranton | 166/151 |
| 4,951,750 | 8/1990 | Wetzel, Jr. | 166/51 X |

*Primary Examiner*—William P. Neuder
*Attorney, Agent, or Firm*—Fidler & Marnock

[57] ABSTRACT

A gravel packing system in which the gravel screen and attached packer are anchorable in a well bore. A cross-over tool has an indicator device which cooperates with the gravel screen to provide surface indications of the downhole tool positions and the operation of a gravel valve. A setting tool can be used with the cross-over tool to set the packer and is releasable by hydraulic pressure. The setting tool and packer are releasably and co-rotatively coupled permitting right hand rotation while going in the well bore. The cross-over tool has a float valve which permits reverse circulation in low pressure wells. The packer has a release system for permitting retrieval of the packer.

33 Claims, 13 Drawing Sheets

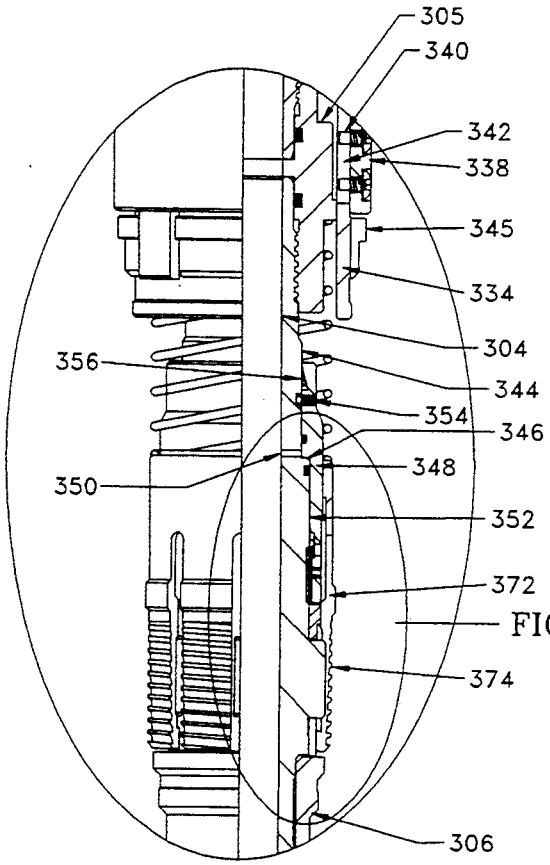
FIG. 15
FIG. 16
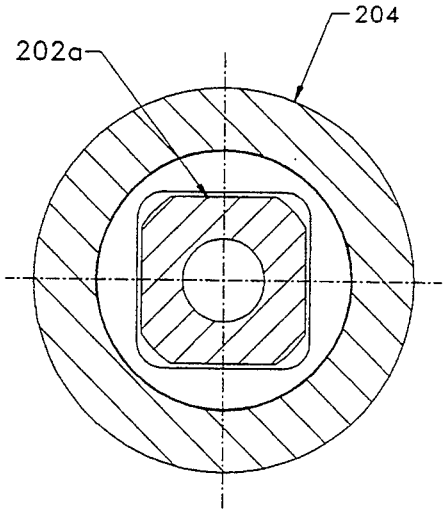
Fig.13
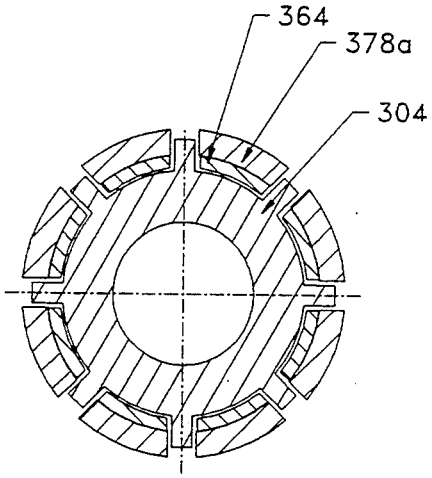
FIG. 17

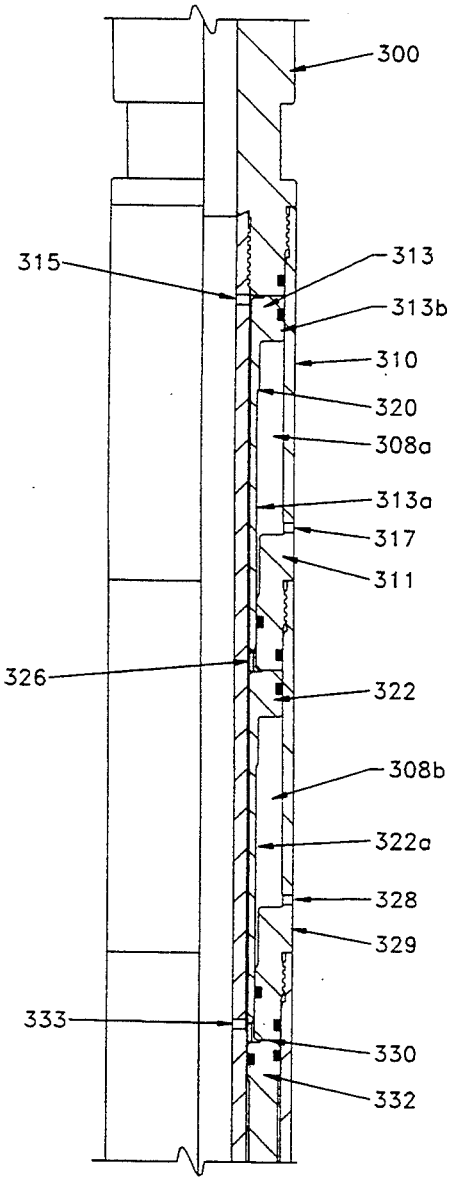
Fig. 14A
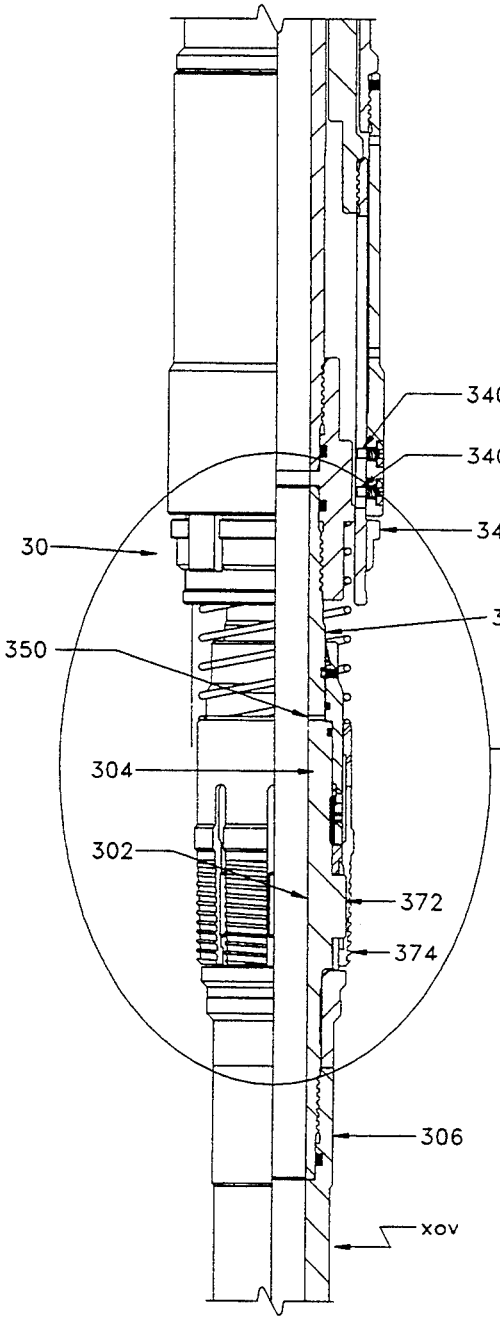
FIG. 15
Fig. 14B

GRAVEL PACKING SYSTEM

FIELD OF THE INVENTION

This invention relates to well tools for use in well bores which traverse earth formations and more particularly to systems and components for downhole oil well tools for performing downhole service operations in a well bore, such as gravel packing in a horizontal well bore. BACKGROUND OF THE INVENTION In drilling a borehole through earth formations, the borehole is never truly vertical and in many instances is deliberately deviated from a vertical by directional drilling. Recent technology has introduced a concept of curving or angling a borehole to have a horizontal or somewhat horizontal length of terminal well bore which can traverse horizontally through vertical layers of earth formations or through a production stratum. With this arrangement, greater quantities of hydrocarbons can be produced from several different layers of earth formations or a production stratum through a string of tubing to the earth's surface. As is customary in the completion of wells, a surface tubular metal casing or coupled lengths of pipe and borehole liners of coupled lengths of pipe are disposed along the length of a borehole with the annulus between the liner and/or casing being filled with cement. The liner is appropriately perforated or slotted along the hydrocarbon producing zones.

In some types of oil well completions, a packer assembly is connected to a gravel packing assembly and lowered through the well bore (the liner bore) so that a packer element on the packer assembly can be located in a liner at a location above an upper hydrocarbon producing zone with the gravel packing assembly extending below the packer element and extending through the length of the production zone traversed by a well bore. The packer element is then actuated to seal off the cross section of the well bore to prevent fluid communication relative to the packer element in the well bore except through the bore of the packer assembly which is coupled to a tubing string.

A setting tool apparatus typically is located on the end of the tubing string and is releasable attached to the packer assembly by a left hand releasable threaded connection. This requires right hand rotation for release. The setting tool apparatus has an attached internally located tubular crossover assembly that extends downwardly through the tubular outer gravel screen which is attached to the packer assembly. The gravel screen includes blank pipe sections as well as porous screen or screen sections. A liquid/gravel mixture is transferred by the cross-over tool to the annulus between the gravel screen(s) and well bore with liquid being filtered through the screen(s) and returned to the surface via the annulus between the string of tubing and the well bore above the packer assembly.

The setting tool apparatus and the crossover assembly are manipulatable by the tubing string relative to the gravel screen assembly to provide the fluid communication path between the bore of the string of tubing and gravel ports in the gravel screen below the packer assembly to flow a liquid slurry of gravel and liquid to the lower annulus between the well bore and the gravel screen. The purpose of the flow of slurry is to pack the lower annulus with gravel for retaining the integrity of the well bore and the earth formations behind the well bore liner where the well bore liner extends through a sand formation. The liquid from the slurry is returned through the gravel screens to a bypass passage in the crossover assembly and the bypass passage communicates with an upper annulus between the tubing string and the packer assembly above the packer element.

After a gravel packing of a lower annulus in the well bore has been completed, the setting tool and the crossover assembly are longitudinally positioned so as to permit a reverse circulation of liquid to remove the slurry from the tubing string and to the earth's surface. After reverse circulating the slurry from the tubing string, the setting tool assembly and crossover assembly are retrieved. Thereafter, a production string of tubing is coupled to the packer assembly hydrocarbon and production from the earth formations occurs through the gravel packed annulus to the production string of tubing coupled to the packer.

In the performance of the above described operations in a deviated or horizontally drilled well bore, or for that matter in any well bore, there are a limited number of tubing string motions available to operate the downhole equipment of the setting tool and crossover assembly. Left hand turning of the tubing string is always undesirable because of the possibility of unscrewing the pipe string at some point along its length. The available motions are up and down movements of the tubing string and right or left turning of the tubing string, or a combination of these motions. The apparatus heretofore utilized for gravel packer has been more or less a one shot operation with little room for error.

Hydraulic pressure in the string of tubing and in the annulus is also commonly used to cause a shear pin release of relatively movable tool parts but is limited in application.

It is also desirable in a deviated or horizontal well bore to be capable of rotating the tubing string to the right to facilitate its entry through the well bore while being lowered into the well bore. As is obvious, if the tubing string and the tool string can be rotated to the right during entry then this motion is lost for purposes of releasing the tool from a gravel packing apparatus.

Prior art patents known to applicants include U.S. Pat. No. 4,553,595 to Huang, et al. in which gravel packing is accomplished in two distinct steps. U.S. Pat. No. 3,987,854 to Callahan, et al. which discloses the hydraulically operated packer on top of a screen section. A setting tool with left hand threads is connected to left hand threads on a packer and carries a crossover tool.

U.S. Pat. No. 4,856,591 to Donovan, et al. discloses the use of stabilizer elements to centralize screens of a gravel pack system in a horizontal well bore. In the '591 patent a releasable right hand rotative coupling interconnection is illustrated which is hydraulically actuated to release a back-up sleeve which releases coupling collet fingers. For mechanical unthreading of the collet fingers, annulus pressure is required to actuate and release an anti-rotation coupling sleeve.

SUMMARY OF THE PRESENT INVENTION

The present invention involves a gravel packing system which is particularly useful for deviated and horizontal well bores. The system includes a packer and attached gravel packing screen tool which are lowered into the well bore by a releasably connected setting tool on a string of tubing with an attached cross-over assembly disposed in the gravel screen tool.

The setting tool has a releasable co-rotational interlock with the packer so that the assembly can be rotated while being lowered into the borehole. The setting tool has a collet type threaded finger connection with an internal thread in the packer bore and is hydraulically releasable, as well as, alternatively mechanically releasable. The packer has packer elements and an anchor means which are actuatably by relative longitudinal motion between a central mandrel and an outer activating sleeve to move between a retracted and an extended position and are locked in an extended position. Release means on the packer can be actuated and include a release sleeve which is releasably converted to a retainer sleeve and normally holds retainer locking elements in locking relation to the central mandrel. When the release sleeve is shifted, the locking elements are released to free up the lower end of the anchor means so that an upward pull on the tubing string release a locking means on an upper expander and stretches out the packer to a contracted condition.

The gravel screen is a tubular outer assembly with upper intermediate and lower restricted bore sections respectively above indicator shoulders. The assembly has a sleeve valve with indicator bore and shoulders as well as collet latching fingers for an indication of opening and closing of the sleeve valve.

The cross-over tool has a resilient indictor means at its lower end which can be resiliently passed through the restricted bores in the gravel tool assembly and gives a surface indication of the downhole positioning of the cross-over tool in the gravel screen and the opening and closing of the gravel valve. The resilient indicator permits repeated operation which can be observed at the surface before, during and after gravel packing.

The cross-over tool includes a float valve which permits reverse circulation in situations where low pressure formations would otherwise be damaged.

In the operation of the system, a gravel screen and packer are disposed in a well bore so that a cross-over tool on a string of tubing can be repeated cycled as necessary to obtain surface indications of the downhole tool position and the operation of the gravel valve. If the tool is functioning properly, a liquid gravel mixture can be transported down the tubing string to be channelled by the cross-over tool to an annulus about the gravel screen below a seal sub. The liquid returns to the earth's surface through a bypass system which extends to the annulus between the string of tubing and the well bore above the packer. In a second position of the cross-over tool, the liquid is channelled by the cross-over tool above the seal sub to return to the earth's surface via the annulus between the string of tubing and the well bore. In a third position of the cross-over tool, the gravel valve is closed and liquid can be circulated down the annulus between the string of tubing and the well bore and reverse circulate the mixture in the string of tubing to the earth's surface where the liquid flow is above a float valve in the cross-over tool which prevents the imposition of hydraulic pressure on the earth formation.

The operation of the packer in conjunction with the setting tool involves dropping a sealing ball and setting the packer and anchoring means. Safety bypass means are provided to prevent hydrostatic pressure buildup before the packer is set. Hydraulic pressure unlocks or releases the collet fingers from the packer by a hydraulic release operated system which retracts the collet fingers and has a lost motion operation in the release and permits the release of the co-rotational interlock.

Various details of the overall system and its components will be apparent from the description to follow.

DESCRIPTION OF THE DRAWINGS

FIG. 13 is a view taken along line 13—13 of FIG. 12A;

FIG. 14A and FIG. 14B is an illustration of a setting tool for the packer shown in FIG. 7A and 7B;

FIG. 15 is an enlargement view of a section of the tool shown in FIG. 14B;

FIG. 17 is a view taken along line 17—17 of FIG. 16;

DESCRIPTION OF THE INVENTION

General assembly

Figure 1:
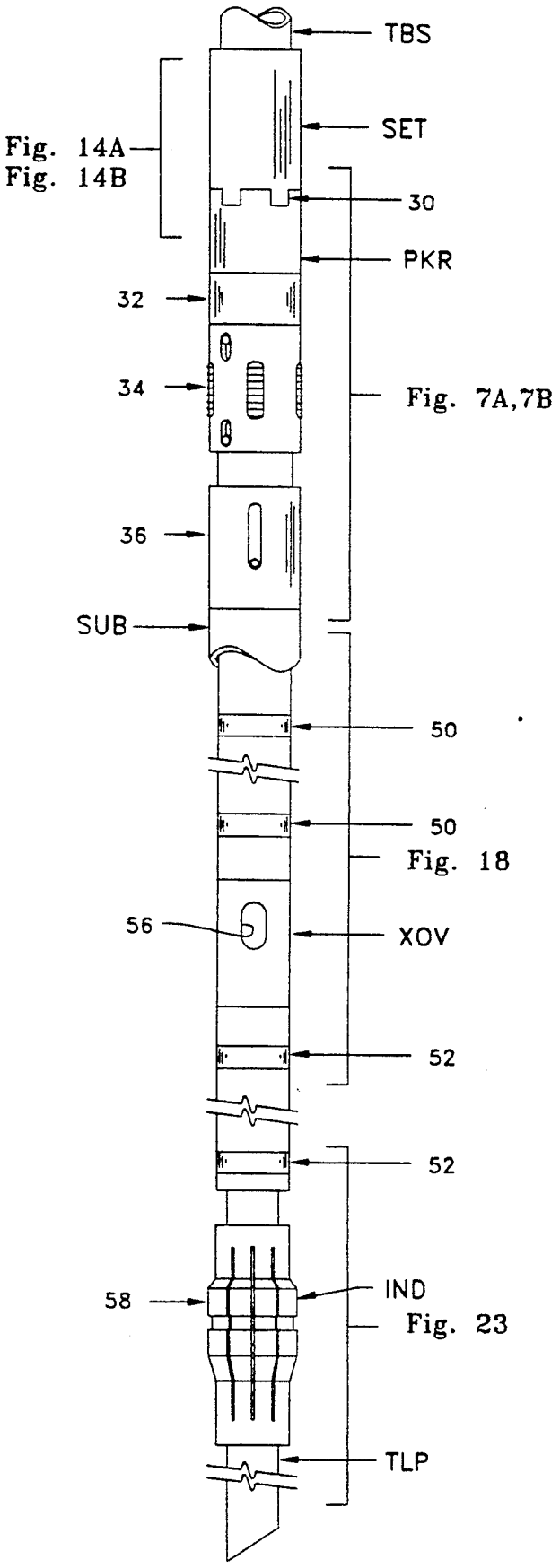
FIG. 1 schematically illustrates a string of tools and partial cutaway for a packer assembly and crossover tool assembly.

Referring now to FIG. 1, a partial string of tools is schematically shown as attached to a tubular string of pipe TBS which extends from the earth's surface (not shown). The string of tools includes a setting tool SET, which is attached to the tubular string of tubing TBS. The setting tool SET is releasably coupled to a packer PKR. Interconnected lugs or castellated members at 30 on the setting tool SET and the packer PKR releasable interconnect the setting tool SET and packer PKR and permit co-rotation of the setting tool and the packer when engaged with one another. The packer PKR includes a packing element 32, slip means 34 and a lower release collar 36. The lower release collar 36 is connected by a tubular member SUB to a tubular outer gravel screen assembly 37 which is schematically shown in FIG. 2.

Figure 2:
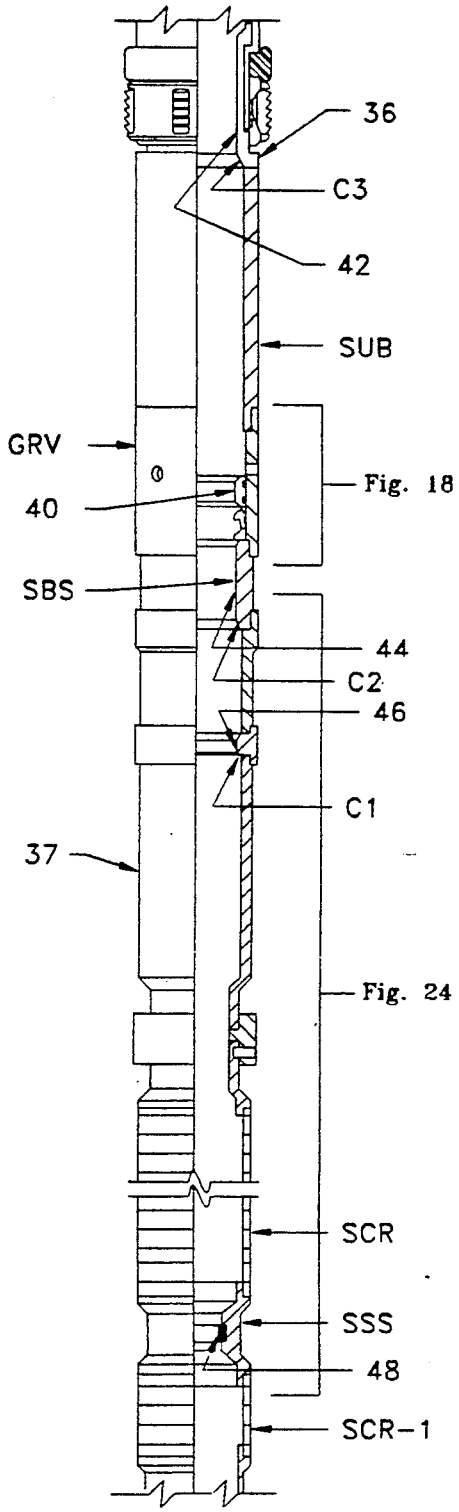
FIG. 2 schematically illustrates in partial longitudinal cross-section a gravel screen assembly.
Figure 3A:
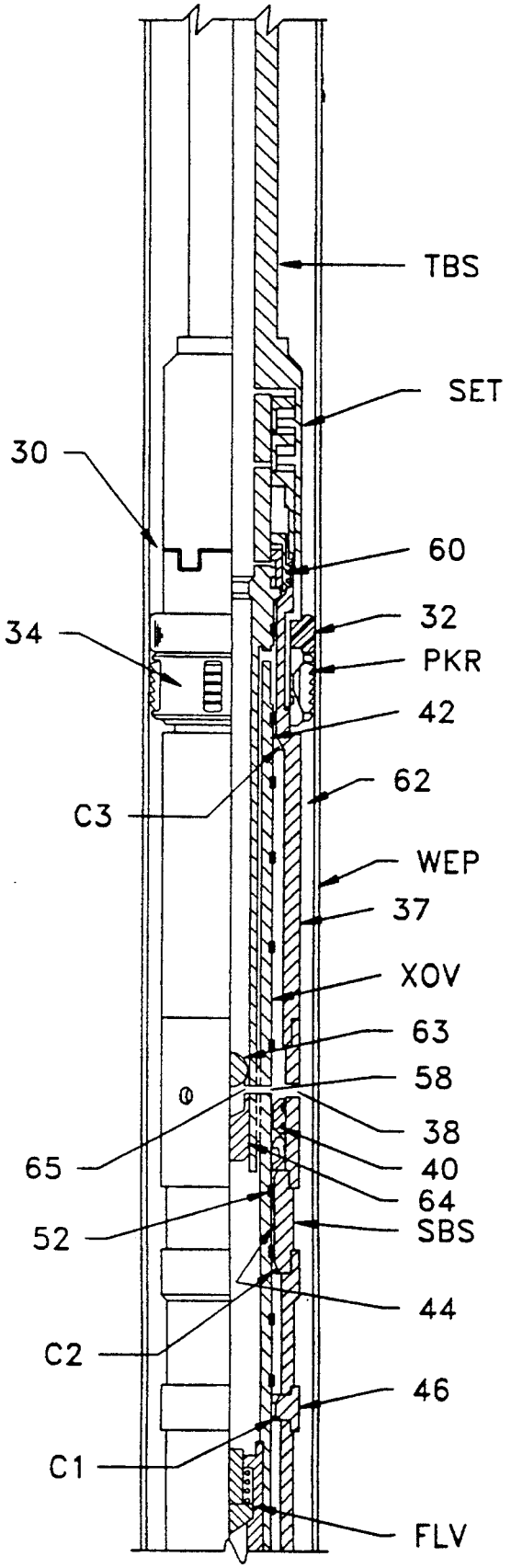
FIG. 3A and 3B are illustrative of the tool in a first position after the packer element 32 is initially set to seal off the well bore.
Figure 3B:
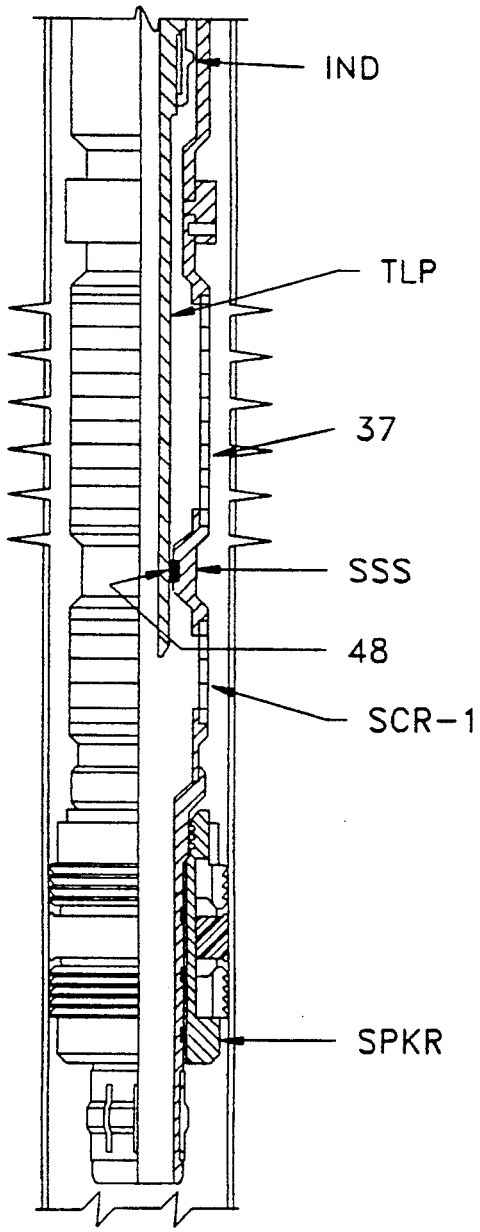

Referring to FIG. 2, the tubular outer gravel screen assembly 37 includes a tubular gravel valve GRV having gravel ports 38 which are shown in an open position with respect to internal sliding sleeve valve member 40. One of the features of the invention is that the gravel valve GRV can be selectively open or closed by manipulation of the setting tool and provide a surface indication of the valve operation. Between the packer PKR and the sub SUB is a downwardly facing internal shoulder C3. The packer PKR has an internal sealing bore 42 located above the shoulder C3.

Below the gravel valve GRV is a tubular sealing bore sub SBS with an internal sealing bore 44. At the lower end of the sealing bore 44 is a downwardly facing internal shoulder C2. Spaced downwardly from the shoulder C2 is an internal flange section 46 with a bore 47 which forms a downwardly facing shoulder C1. Below the shoulder C1 are blank pipes and/or screens SCR. The lowermost screen SCR is attached to a sealing sub SSS which has an internal sealing bore 48 with an internal seal packing. Below the sealing sub SSS is another screen member SCR-1. Typically, the screen member SCR-1 is located below the perforations in the well casing.

Referring back again to FIG. 1, the setting tool SET is connected by a tubular member (not shown in FIG. 1) extending through the packer PKR to a tubular crossover tool XOV which extends into the tubular outer screen assembly 37 below the packer PKR (See FIG. 2). The crossover tool XOV has longitudinally spaced upper, exterior sealing means 50 along its length and longitudinally spaced lower exterior sealing means 52 along its length. The sealing means 50 and 52 are located above and below radial crossover ports 56 in the crossover tool XOV. The sealing means 50 and 52 are adapted to be received in the respective sealing bore 42 of the packer PKR and the bore 44 of the sealing bore sub SBS (see FIG. 2) so that the crossover ports 56 in the crossover tool XOV can communicate with the gravel ports 38 in the gravel valve GRV.

Again referring to FIG. 1, below the lower seal member 52 on the crossover tool XOV is a tubular tail pipe TLP and an indicator collar IND. The indicator collar IND has resilient arm members 58 which are adapted to be compressed radially inward toward the central axis of the indicator collar in response to compression within a restricted or smaller diameter bores 47,44 and 42 located above each of the shoulders C1, C2 or C3. The arm members 58 are compressed inwardly in response to a pulling or strain force on the tubing string TBS until a predetermined pulling force value is reached which causes the arm members 58 to be compressed in one of the bores 47, 44 or 42 and to slide through such bore. The entry of the arm members 58 into one of the bores 47,44 or 42 provides a quick upward movement or release for the tension in the tubing string TBS. The upward movement is easily observed and indicates to the surface operator that a position C1, C2 or C3 was located by the indicator collar. The reverse action occurs when the string of tubing is moved downwardly from the C3 position to the C1 position. Thus, the operator can determine that the tool is functioning properly and can recycle this operation as many times as desired to obtain surface indications of operation and location.

Also indicated in FIGS. 1 and 2 are references to other figures for further details of the particular components and assemblies.

GRAVEL PACKING

Referring now to FIGS. 3–6, the schematic drawings are illustrative of the fundamentals of a gravel pack operation utilizing the present invention. As shown in FIG. 3A and 3B, the setting tool SET, the packer PKR and the crossover tool XOV are partially illustrated in an assembly position after insertion through a well pipe WEP in a well bore and after setting of the packer element 32 of the packer PKR. The lower end of the screen assembly 37 is slidably and sealingly received in a conventional sump packer SPKR which has previously been set in the well bore. In the going-in position of the assembly, the tubular sleeve valve member 40 in the screen assembly 37 is located below the gravel ports 38 in the gravel valve while the sealing means 50 engage the seal bore 42 in the packer PKR and sealing means 52 engage the seal bore 44 in the seal bore sub SBS. The indicator collar IND on the crossover tool XOV is located below the shoulder C1 on the flange section 46. The lower end of the tail pipe TLP is sealingly received in the bore 48 of the sealing sub SSS (FIG 3B) and the tail pipe TLP opens to the bore below the sealing sub SSS to the interior of the screen SCR-1. The setting tool SET has left handed threads 60 in releasable threaded engagement with left handed threads in the bore of the packer PKR. Because of the interconnected fingers at 30, right hand rotation will not release the setting tool from the packer.

A sealing ball 63 is dropped or pumped down to a valve seat 64 and the hydraulic pressure in the tubing string TBS is increased to a second and higher level which is sufficient pressure on the ball to set the packer PKR.

When the packer PKR is set, as shown in FIG. 3, slip members 61 in the slip means 34 are in engagement with the wall of the well pipe WEP and the elastomer packing element 32 is expanded to close off fluid communication in the annulus 62 located between the well packer PKR and the well pipe WEP below the packing element 32.

The valve seat 64 has ports 65 which permit fluid bypass while the tool is run in the well bore. The sealing ball 63 closes off the ports 65. The valve seat 64 is shear pinned to the crossover tool XOV and, in the position shown, with the sealing ball 63 closes off crossover ports 58 in the cross over tool XOV. When hydraulic fluid pressure in the string of tubing TBS is used to actuate a hydraulic setting tool to set the slip elements 61 and the packer element 32, the interconnected lugs at 30 are separated from one another. After the packer element 32 is expanded to a set condition, the left hand threads 60 of the setting tool SET are released from the threaded bore in the packer PKR by the applied hydraulic pressure. When the threads 60 are released, an upstrain is taken on the string of tubing TBS so that the indicator collar IND can successively engage the shoulders C1, C2 and C3. At each of the engagements with the shoulders C1, C2, and C3, the rig load indicator (not shown) at the earth's surface will provide an indication when a predetermined load is obtained by the indicator collar IND engaging a shoulder. The indicator collar IND is designed to collapse or compress when the predetermined load is exceeded so that the indicator collar IND can pass through the smaller bore section located above a shoulder. If the operator observes the rig load indicator responses for each of the interactions of the indicator collar IND with the respective shoulders C1, C2 and C3, then the operator is assured that the setting tool set is released and is movable between three operating positions, C1, C2 and C3. This checking can be repeated. When the indicator collar IND engages the sleeve valve member 40 on upward movement, the valve member 40 is moved upwardly to close off the gravel valve ports 38 before the collar IND passes through. On a downward stroke where the collar IND is above the sleeve member 40, the collar IND will move the valve member 40 down and open the ports 38. Thus, the valve ports 38 are selectively opened and closed. Should the hydraulic release fail to operate, the setting tool can be alternatively released by right hand rotation.

Figure 4A:
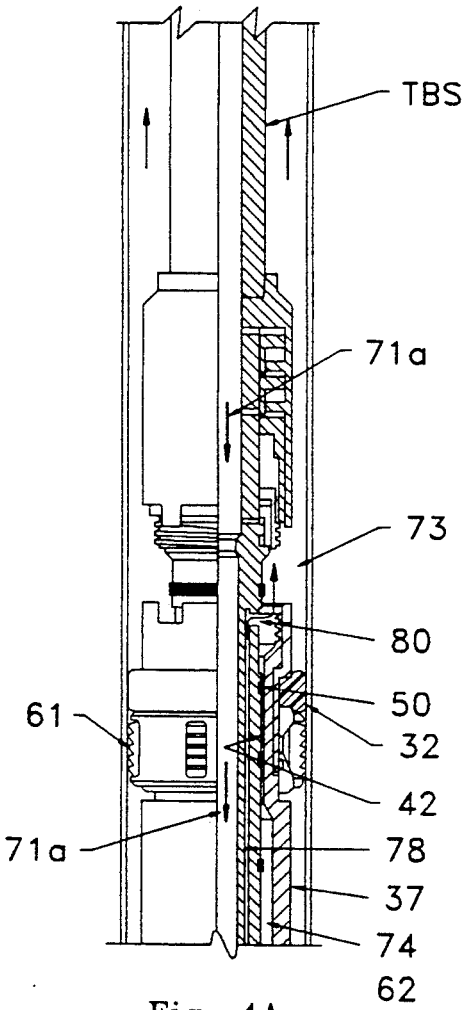
FIG. 4A and 4B are illustrative of the tool in position for pumping a gravel slurry to the annulus 62 between the packing means 32 and the lower sump packer SPKR.
Figure 4B:
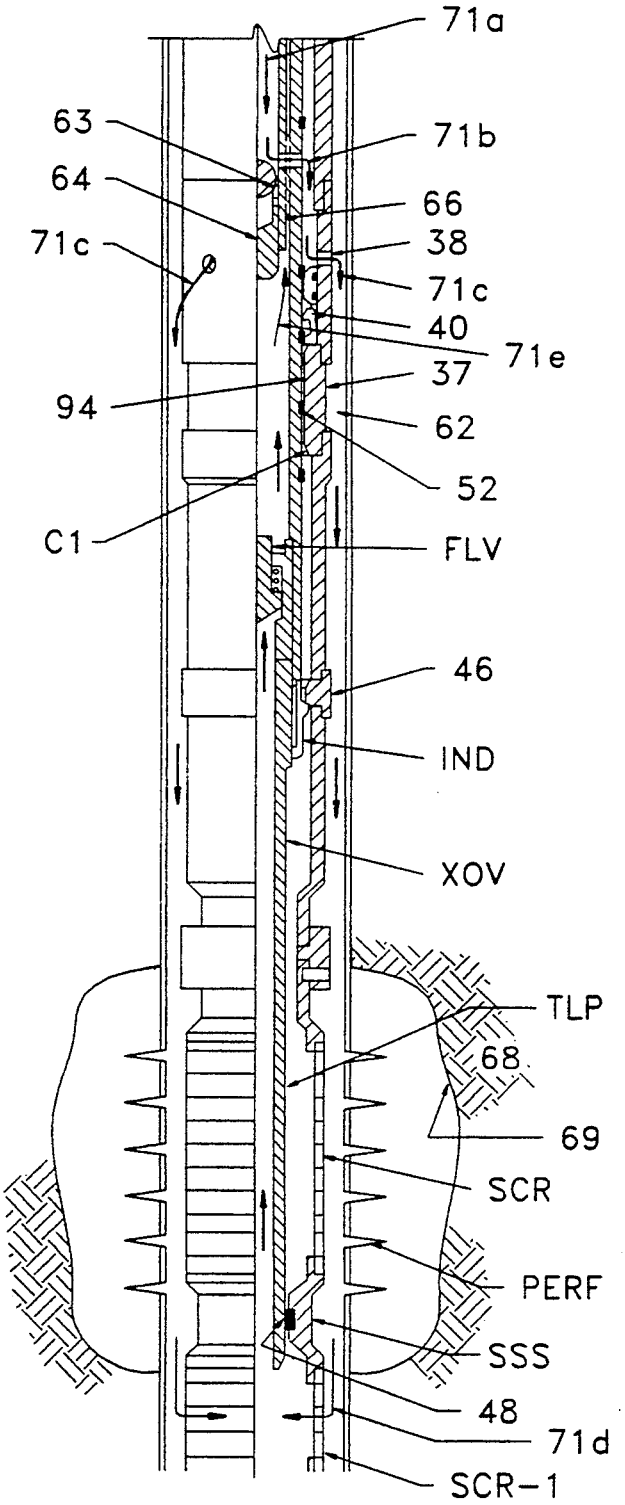

In any event, after checking the tool operation, the tubing string TBS is then lowered so the indicator collar IND again opens the gravel valve ports 38 by sliding the valve sleeve 40 downwardly and the indicator collar IND is returned to a position in engagement with the shoulder C1 (See FIG. 4B). In this condition, the tail pipe TLP on the lower end of the crossover tool is in sealing engagement with the bore 48 of the sealing sub SSS and the setting tool set is disengaged from the packer PKR.

Referring now to FIG. 4A and 4B for the next sequence of operation, after the ball 63 is dropped or pumped down to a valve seat 64 and the seating tool is released, the setting tool is raised to a reverse position where the hydraulic pressure in the tubing string TBS is increased to a second and higher level which is sufficient pressure on the ball 63 to cause a shear pin (not shown) to shear and to permit the valve seat 64 to move downwardly and thereby open the crossover ports 58 in the crossover tool to the interior of the string of tubing. The crossover tool XOV at the location of the radial crossover ports 58 has longitudinally extending bypass passages 66 which are located in circumferential locations about a longitudinal axis and are circumferentially spaced at locations between the radial crossover ports 58. The bypass passages 66 (shown in dashed line in FIG. 4B) extend upwardly into an annular space which has exit ports 80 in the setting tool SET which open to the exterior of the bypass tool XOV. In the position of the tool shown, the exit ports 80 communicate with an annulus 73 between the well pipe and the tubing string and which is located above the packing element 32.

As illustrated in FIG. 4B, the earth formations 68 have eroded and formed a cavity 69 behind the well pipe WEP.

As shown by the outline arrows 71 in FIGS. 4A & 4B, a liquid and gravel mixture or slurry can be pumped down under pressure through the bore of the string of tubing TBS (Arrow 71*a*) to pass through the crossover ports 58 (Arrow 71*b*) into an annulus 74 between the crossover tool and the well screen assembly. The mixture then passes through the gravel ports 38 (Arrow 71*c*) into the annulus 62 between the screen assembly and the well bore. The mixture flows downward to the lower end of the annulus 62. The bottom end of the screen assembly SCR-1 is typically located just above the bottom of the well bore or above a sump packer SPKR (See FIG. 3B) and just below the perforations. In any event, gravel from the liquid slurry or mixture is transmitted via the perforations into the earth cavity 69 behind the well pipe WEP and is also retained within the annulus 62 while the liquid from the mixture is passed through the porous screens SCR and SCR-1. Because the tail pipe TLP is sealed in the bore 48 of the seal sub SSS, the fluid return (as shown by the line arrows 71*d*) is through the screen SCR-1 to the central bore of the tail pipe to and through a float valve FLV to the bypass passages 66 (Arrow 71*e*)to an annulus 78 between the setting tool and cross-over tool to the exit ports 80 which are located above the packer element. The liquid then returns to the earth's surface via the annulus 73 between the tubing string TBS and the well pipe WEP. In this position of the crossover tool, the indicator member IND is in engagement with the shoulder C1.

Figure 5A:
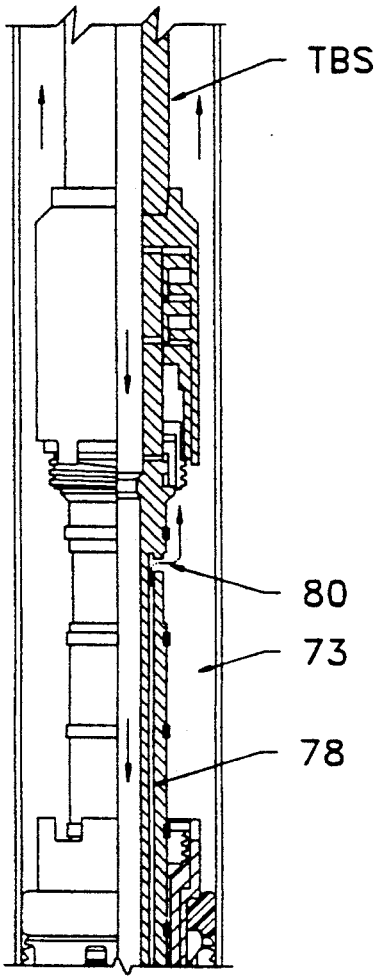
FIG. 5A and 5B are illustrations of the tool in a position for pumping a gravel slurry to an upper screen assembly.
Figure 5B:
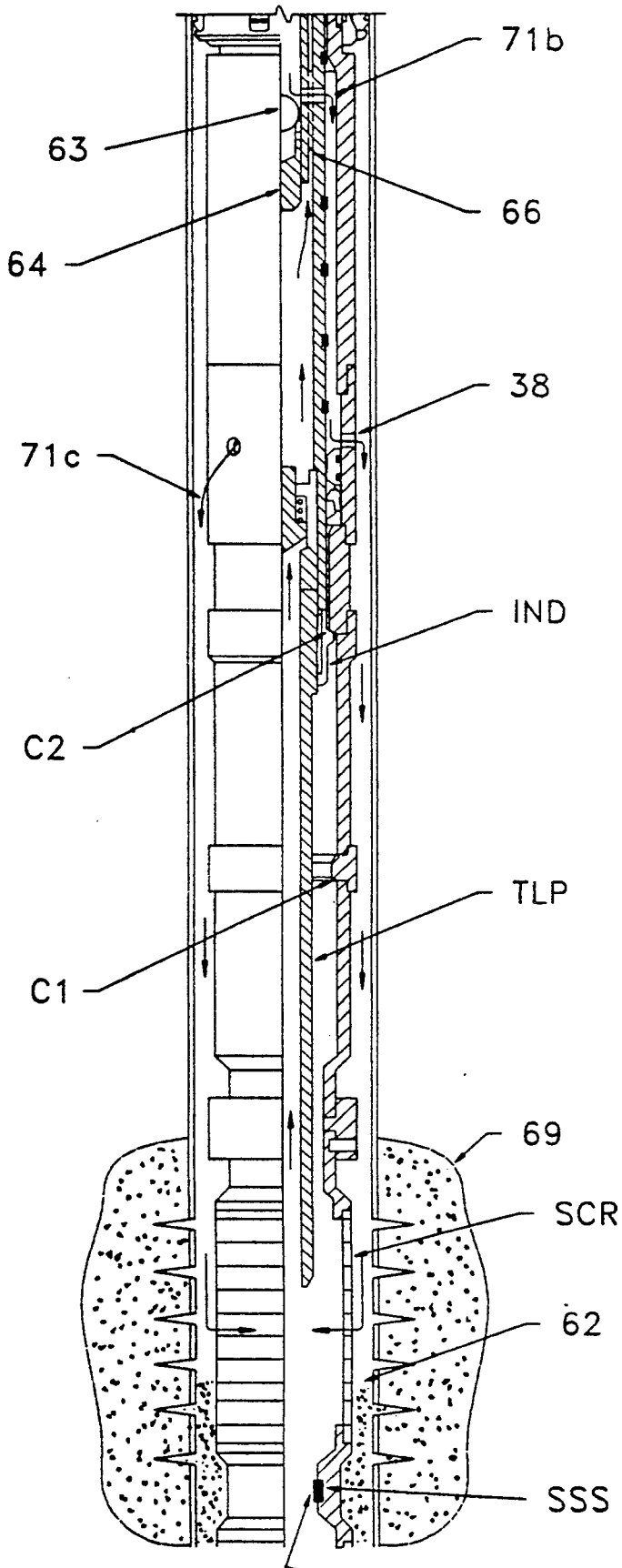

After gravel has been packed into the portion of the annulus 62 located below the seal sub SSS, the tubing string TBS is raised to engage the indicator collar IND with the shoulder C2 (See FIG. 5B). The operation can detect this location at the earth's surface. In this position, as shown in FIGS. 5A and 5B, the open end of the tail pipe TLP is located above the bore 48 of the seal sub SSS so that liquid can be returned through the porus screen SCR which is located along the perforations. At this time the cavity 69 is packed with gravel. The passage of the slurry and return of liquid through the tool is otherwise as explained with respect to FIGS. 4A and 4B. This permits packing of gravel in the perforations and the formations adjacent to the screens.

Figure 6A:
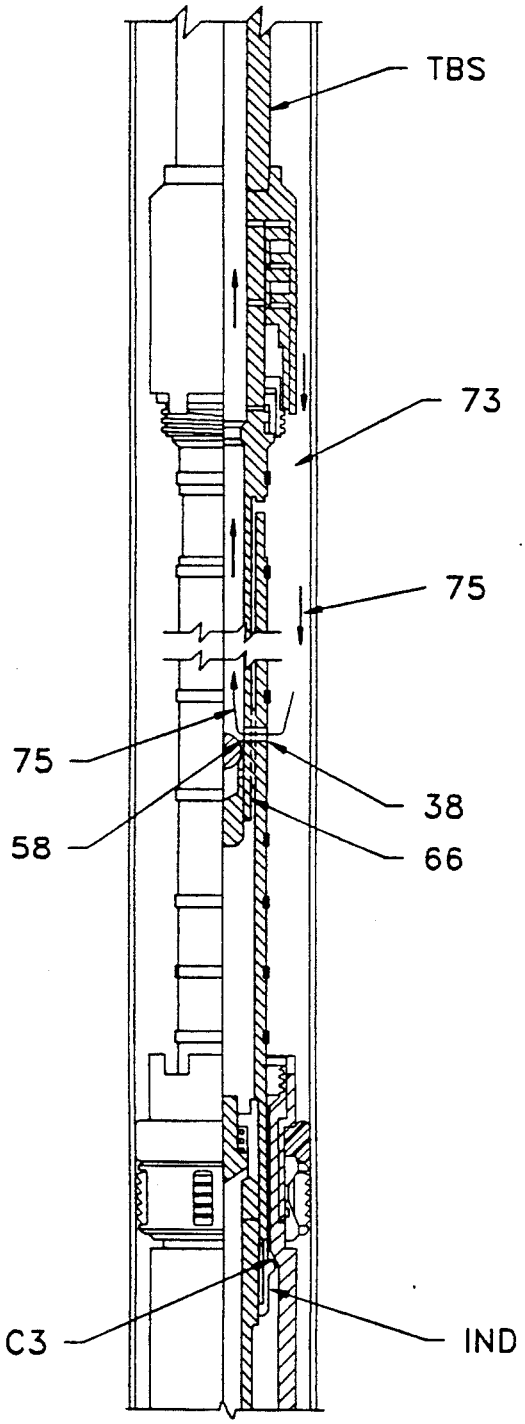
FIG. 6A and 6B are illustrations of the tool in a position for reverse circulation of the gravel mixture from the tubing string.
Figure 6B:
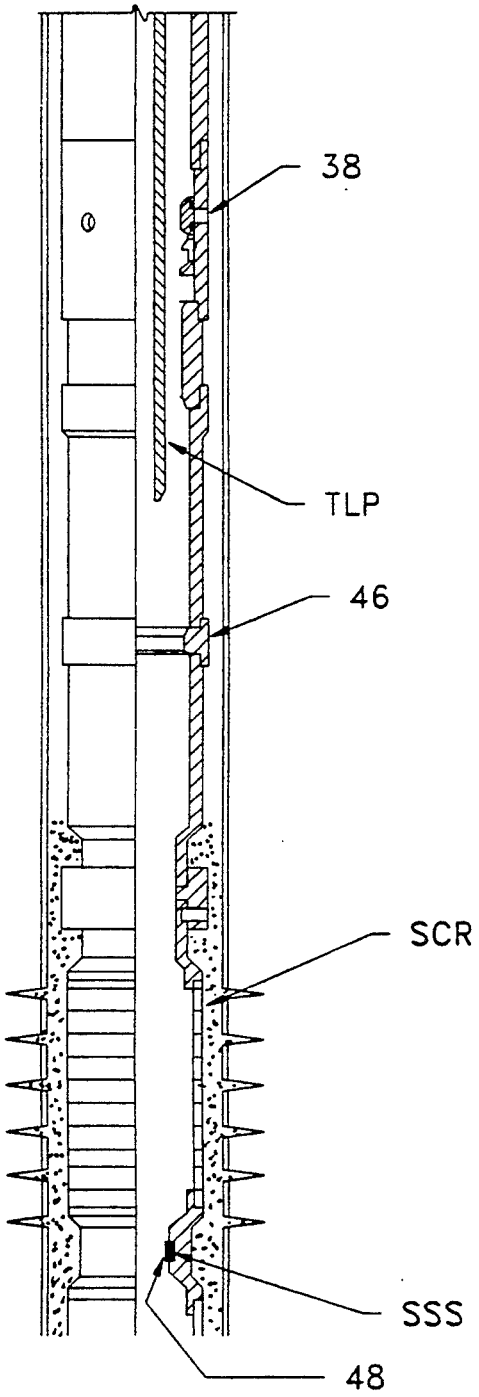

After completing this step of the operations, the tubing string TBS is raised to engage the indicator collar IND with the shoulder C3 as shown in FIG. 6A and 6B. The operator can detect this location at the earth's surface. In this position, both the crossover ports 58 and the gravel ports 38 are located above the packer element 32. Mud or other control liquid can be pumped down the annulus 73 to reverse the flow of gravel liquid mixture to the ground surface (see Arrows 75) through the tubing string TBS.

During the above operations the various seals and seal bores maintain fluid continuity of the tubing string and the crossover tool with the packer and the gravel screens.

PACKER

Figure 7A:
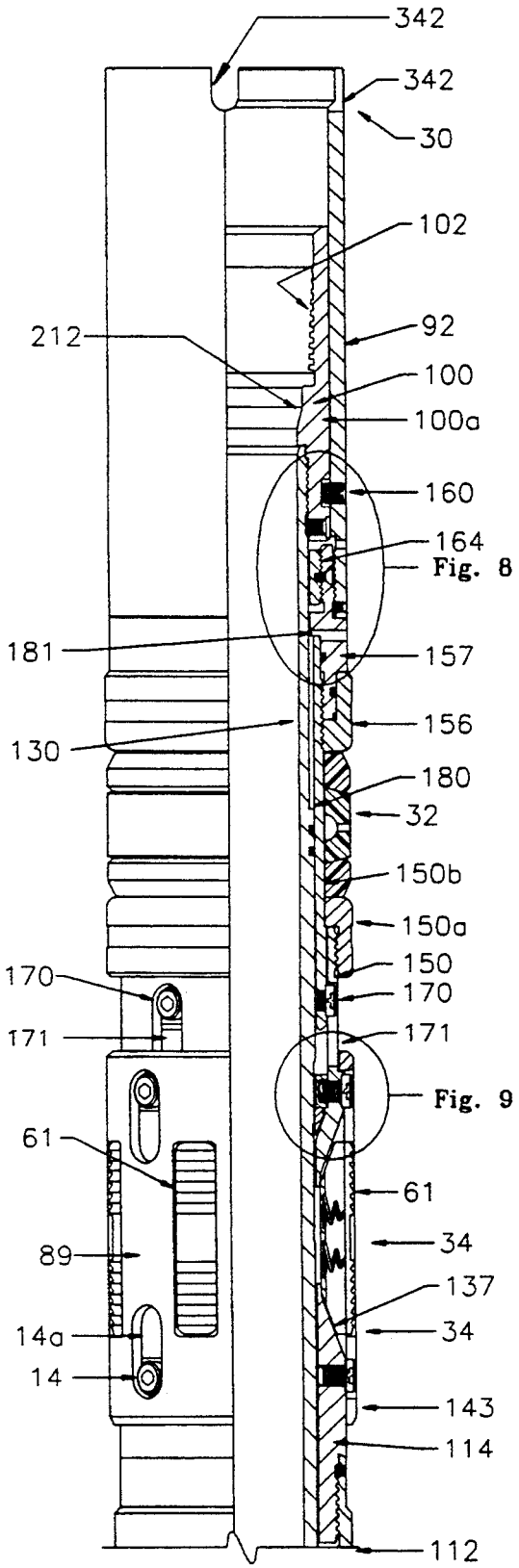
FIG. 7A and 7B is an enlarged illustration in partial cross-section through the packer PKR (see FIG. 1)
Figure 7B:
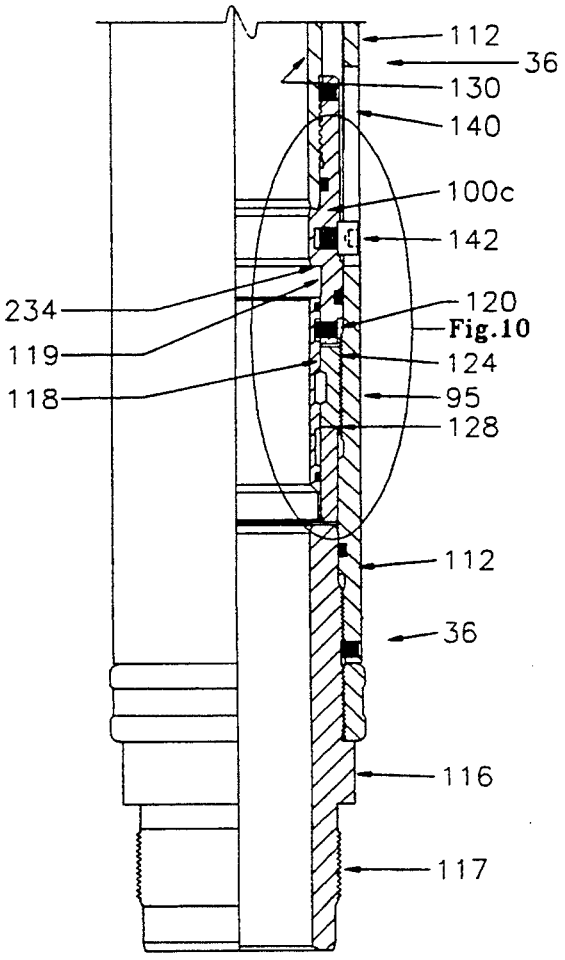

Referring now to FIG. 7A and 7B (and to FIGS. 8, 9 and 10 for enlarged illustrations) the packer PKR of the present invention has circumferentially arranged slip members 61 in a tubular slip cage 89 where the slip members 61 are radially movable for gripping engagement with the wall of a pipe for preventing movement in either direction relative to the pipe. The elastomer packing elements 32 are radially expandable from a retracted condition to an extended condition to sealingly engage the wall of the pipe and to effectively block or packoff the annulus between the pipe and the well tool. The slip members 61 and the packing elements 32 are actuatable in response to a longitudinal setting motion of an outer tubular member or setting sleeve 92 relative to an inner tubular member or mandrel 100. The relative longitudinal motion first actuates the slip members 61 to move from a retracted position to a wall engaging position and then moves the packing elements 32 from a retracted to an expanded wall engaging condition. The inner mandrel 100 and outer member 92 are locked to one another by a one way ratchet system to maintain the packer in a set position.

A release system 95 (See FIG. 10) is selectively actuatable to release the packing elements 32 and the slip members 61 from the set position and enabling the packing elements and the slip members to return to a retracted condition.

The construction of the packer includes the tubular central mandrel 100. The tubular mandrel 100 includes a member of interconnected elements including a top sub 100*a*, a central mandrel section 100*b*, and a segment retainer 100*c*. The upper end of the top sub 100*a* has a internal left hand thread 102 which is adapted to cooperate with a left hand threaded device 60 on the setting tool. This left handed threaded connection provides a secondary release mechanism to release the setting tool from the central mandrel by right-hand rotation. As will be explained hereafter, the primary release mechanism for the setting tool threads is hydraulically actuated to release the threaded connection.

The packer and anchor assembly which includes the packing means 32 and the anchoring means 34 are disposed on the central mandrel 100. Beginning at the lower end of the packer and anchor assembly (FIG. 7B), a tubular sub element 116 has a threaded end 117 for threaded attachment to the outer gravel screen assembly. The upper end of the sub 116 is connected to a tubular slip connector sleeve 112. The connector sleeve 112 is slidably disposed on the segment retainer 100*c* and extends upwardly to a connection with a lower slip cone 114 (FIG. 7A) located in the slip assembly 34.

Figure 10:
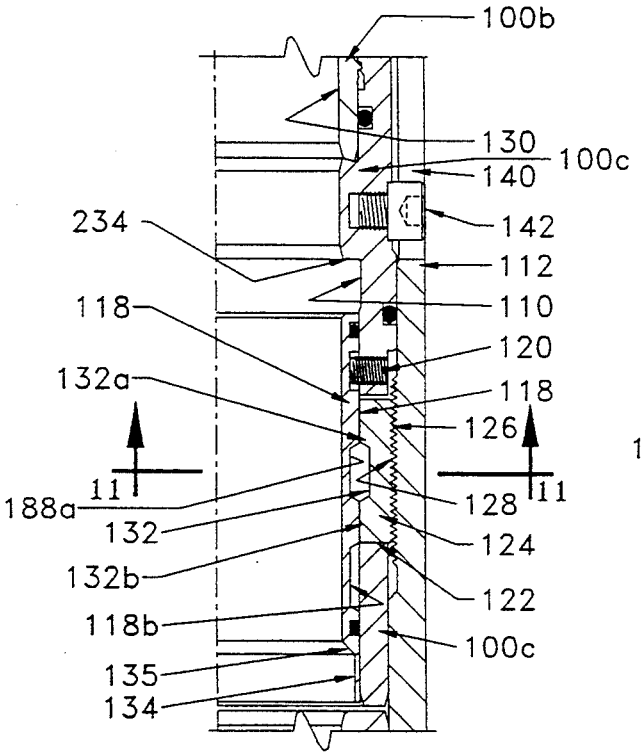
Figure 11:
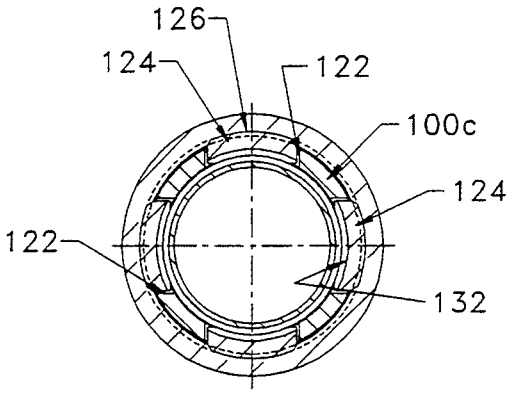
FIG. 11 is a view in cross-section taken along line 11—11 of FIG. 10.

As shown in FIG. 7B, FIGS. 10 and 11, the segment retainer 100*c* (see also FIGS. 10 and 11) has an internal annular recess or counterbore 119 which slidably and sealingly receives a tubular release sleeve 118. The release sleeve 118 is releasable coupled to the segment retainer 100*c* by a shear pin 120. The segment retainer 100*c* has circumferentially located windows or rectangularly shaped openings 122 (See FIG. 10 and 11) which respectively receive solid arcuately shaped lock segments 124. The lock segments 124 have external screw threaded portions 126 which threadedly engage an internal threaded bore section 128 in the connector sleeve 112.

The tubular release sleeve 118 has an internal bore diameter similar to the diameter of the bore 130 of the mandrel section 100*b*. The lock segments 124 are each provided with an internal, horizontal located, release groove 132 to define a spaced apart, upper tab element 132*a* and lower tab element 132*b*. In the position of the release sleeve 118 illustrated in FIG. 10, there are two annular grooves 118*a*, 118*b* in the release sleeve 118 which are spaced from one another and which have widths which are sized so that if the release sleeve 118 is shifted upwardly an appropriate distance, the upper and lower end tab elements 132*a*, 132*b* of the lock segments 132 will be received in the upper and lower annular grooves 118*a*, 118*b* and will release the lock segments 132 for movement inwardly toward the central axis of the tool. When the lock segments 132 move inwardly, the threaded engagements of the threaded portions 126 with the connector sleeve thread 128 are released and thus the slip connector 112 is released from interconnection with the lower segment retainer 100*c*.

Upper and lower seal means on the release sleeve 118 (FIG. 10) provide a debris barrier for the release sleeve 118 relative to the lower segment retainer 100*c* and prevent intrusion of debris. A vent port 118*a* is located between the seals. In the lower end of the release sleeve 118 is a counterbore 134 which defines a downwardly facing latching shoulder 135 and latching recess. The latching shoulder 135 is engageable by a release tool (to be described hereinafter) for shifting the release sleeve 118 upwardly and for obtaining release of the lock segments 124 to release the connector sleeve 112. When the connector sleeve 112 is released from the lower segment retainer 124, the lower expander cone 114 and the slip connector sleeve 112 (See FIG. 7) are slidable longitudinally relative to the segment retainer 100*c*. Longitudinal slots 140 in the lower slip connector 112 and guide pins 142 in the lower segment retainer 100*c* (FIG. 7B) permit relative longitudinal movement but otherwise co-rotatively couple the connector sleeve 112 to the segment retainer 100*c*.

As shown in FIG. 7A, the slip connector 112 is connected to the tubular lower cone member 114 which has an upwardly facing inclined or frusto-conical expander surface 137 which is engageable with expander surfaces on double inclined slip elements 61. A number of slip elements 61 are circumferentially arranged and located in elongated slots in tubular slip cage 89 which is disposed about the circumference of the tool. The slip members 61 at their lower ends, are located within the slip cage 89 and the cone member 114 has radial pins 141 (FIG. 7A) which are longitudinally slidable in longitudinal slots 141*a* in the slip cage 89. This permits relative longitudinal movement between the lower cone member 114 and the slip elements 61 for moving the slip elements 61 from a retracted position shown to an extended position where the outer serrated edges of the slip elements grip the wall of a pipe.

The upper cone member 144 has a downwardly facing inclined surface which engages each upper internal end of a slip member 61 and similarly the cone member 144 is connected by pins 145 to a longitudinal movement slot 146 in the slip cage 89. The upper cone member 144 has an internal annular clutch recess 148 (see FIG. 9) which contains a one-way clutch or ratchet member 149. The ratchet member 149 has internal serrated teeth which engage a serrated outer surface of the mandrel 100*b* when the cone member 144 moves downwardly. The ratchet member 149 prevents return movement of the upper cone member 144 relative to the central mandrel 100*b* and thus holds the slips in a set position by preventing the slip 144 form moving upward relative to the mandrel.

The upper cone member 144 is connected by a tubular extension 150 to a lower gauge ring 150*a* and to a tubular support sleeve 150*b*. The support sleeve 150*b* is slidably mounted on the mandrel 100*b*. The lower gauge ring 150*a* forms the bottom support for an end element of an elastomer packing means 32. The packing means 32 is a three piece packer element construction consisting of a lower element, a center element and an upper element constructed of elastomer material. The tubular element support sleeve 150*b* supports the inner surface of the elastomer elements and permits the movement of the mandrel relative to the packing elements. Above the upper packer element is an upper gauge ring 156. The upper gauge ring 156 is connected to a lock ring support 157 (see FIG. 8). The lock ring support 157 is connected to the support sleeve 150*b* and to the tubular external setting sleeve 92 which extends upwardly beyond the end of the central mandrel 100*a*. The setting sleeve 92 is releasable connected to the mandrel 100*a* by a shear pin 160.

Figure 8:
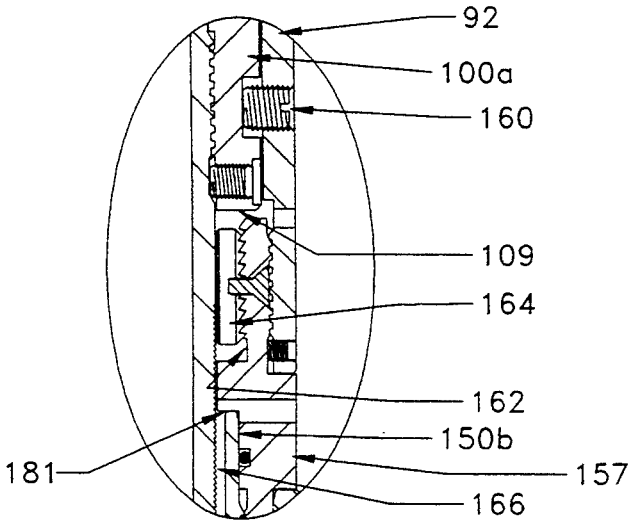
FIGS. 8, 9 and 10 are enlargement of sections of the packer shown in FIG. 7 and 7B.
Figure 9:
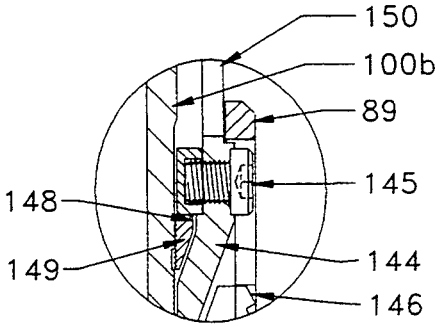

The lock ring support 157 has an internal annular space 162 with respect to the tubular mandrel 100*b*, which receives a "C" shaped locking element 164 (See FIG. 8). The locking element 164 has inner and outer interacting serrated teeth arranged with respect to the lock ring support 157 and an inner gripping serration 166 on the mandrel 100*b* so that when the mandrel 100*b* and the lock ring support 157 are moved relative to one another, the teeth provide a one way ratchet locking action. The gripping serration 166 on the mandrel 100*b* extends along the mandrel surface a sufficient distance for one way ratcheting of the locking element 164 when the ring support 157 is moved relative to the central tubular member 100*b*. It should be appreciated that the pitch on the inner and outer serrated teeth of the locking element 164 are different and such that an upward force on the ring support 157 permits movement upwardly with respect to the mandrel 100*b*.

The setting tool (which will be explained hereafter) is releasable attached to the central mandrel 100 by the left-hand thread 102 so that a downward force can be applied to the setting sleeve 92 to move the setting sleeve 92 downwardly with respect to the mandrel 100. After shearing the pin 160, downward motion of the setting sleeve 158 drives the upper gauge ring 156 downwardly and the stiffness of the packing elements 32 does not permit their initial expansion so that the downward motion is imparted to the upper cone member 144 and to the slip elements 61 in the slip cage 89. The lower cone element 114 is held fixed relative to the tubular mandrel 100 by the lock segments 124 in the segment retainer 100*c* (See FIGS. 10, 11). The lower end of the slip elements 61 move up the inclined ramp 137 on the lower expander cone member 114 and extend radially outward until they engage the wall of the well bore whereupon continued force is applied by the upper expander cone member 144 to the upper end of the slip members 61. The ratchet member 149 prevents return movement of the cone member 144 (See FIG. 9). The continued downward force on the setting sleeve 92 then expands the packing elements 32 with the support sleeve 150*b* sliding relative to the upper cone member 114 until the packing elements 32 are in sealing engagement with the wall of the pipe. The sliding motion is permitted by a pin 170 and slot 171 coupling. The ratchet body lock ring 164 retains the ring support 157 in a fixed position with the packing elements 32 expanded and the slip elements 61 expanded into contact with the wall of the well bore.

The packer is released by use of a packer release tool (to be explained hereafter) where the release tool extends through the central mandrel 100 and has a latch mechanism which engages the downwardly facing shoulder 135 in the release sleeve 118 (See FIG. 10). Upward movement of the packer release tool then applies an upward force sufficient to shear the shear pin 120 so that the annular grooves 118*a*, 118*b* in the release sleeve 118 are registered with the end tab portions 132*a*, 132*b* of the lock segments 132 releasing the connector sleeve 112 and lower cone member 114. When the lower connector sleeve 112 and the cone member 114 are released, the mandrel 100 can be moved upwardly until an upwardly facing shoulder 180 (FIG. 7A) on the mandrel 100*b* engages a downwardly facing shoulder 181 in the upper ring support 157. This engagement permits the upper ring support 157 to be moved upwardly (by ratcheting of the ring 164) thus releasing the force on the packer element and permitting the expander elements 32 to retract. The expander elements 32 retract until the upward facing shoulder 180 on the support sleeve (150B) engages the downward facing shoulder on the lower gage ring (150A) and pulls the upper cone upwardly. In turn, the upper cone element engages a shoulder in the cage element 89 whereupon the cage 89 is pulled upwardly to release the slip elements and the windows in the slip cage pull the slips up which in turn, pulls the slip elements from the lower cone element 114. The system is then released and can be retrieved from the well bore.

PACKER RETRIEVING TOOL

Figure 12A:
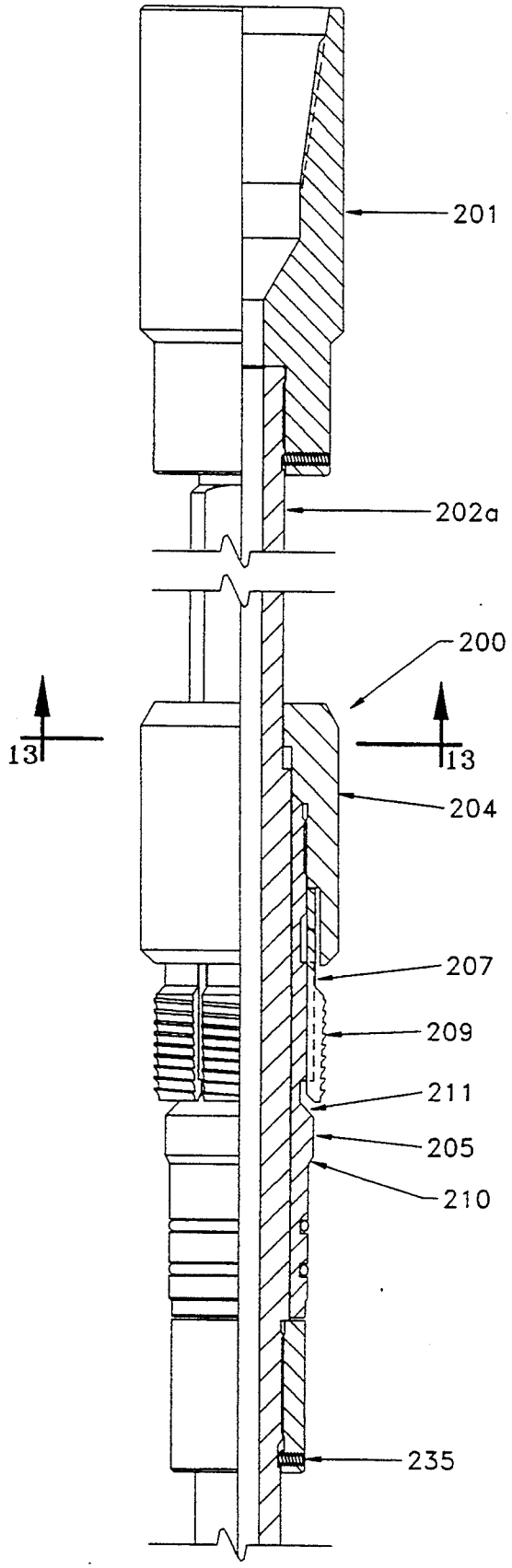
FIG. 12A and 12B is an illustration of a packer retrieving tool for the packer shown in FIG. 7A and 7B.
Figure 12B:
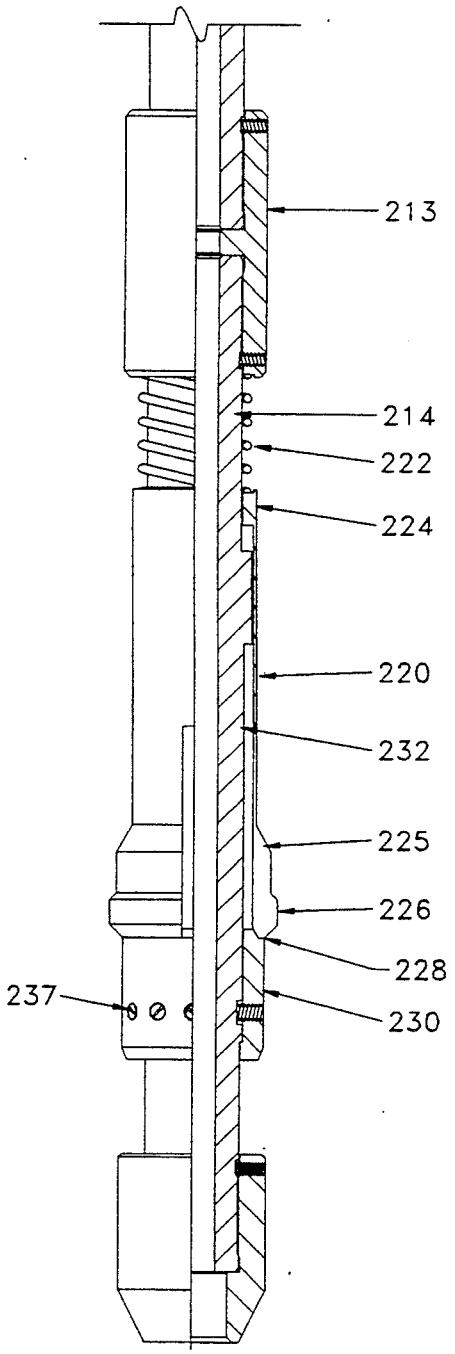

The packer retrieving tool 200, as shown in FIG. 12A and 12B of the drawings, includes a tubular top sub 201 adapted to be coupled to a string of tubing. The top sub 201 is coupled to a tubular upper mandrel 202.

The upper mandrel 202 has a section 202*a* with a non-circular cross section (See FIG. 13) which is slidably and non-rotatably received in a non circular bore of a tubular latch retainer 204. The latch retainer 204 has a tubular lower extension 205 which supports a latch ring 207 with collet fingers 209. The collet fingers 209 are externally threaded with left-hand threads matching the threads 102 in the packer (See FIG. 7). The collet fingers 209 are keyed by longitudinal key members on the tubular extension 205 so as to co-rotate with rotation of the mandrel 202.

When the tubular extension 205 is inserted in the upper open end of a packer (See FIG. 7A) the collet fingers 209 resiliently move inwardly and a downwardly facing shoulder 210 is brought into engagement with an upwardly facing shoulder 212 in the packer. Thereafter, an upward strain on the tubing string causes an upwardly facing surface 211 on the retainer 204 to engage the ends of the collet fingers 209 to move the collet fingers radially outward so as to lock the collet fingers 209 in the threads 102 of the packer mandrel 100.

The mandrel 202 is also connected by a sub 213 (FIG. 12B) to a lower mandrel 214 which carries a latching mechanism for operating the release sleeve 118 (FIG. 10). The packer release prepares the packer for retrieval. The latching mechanism includes a tubular catch sleeve 220 which is biased to a downward position by a spring member 222 disposed between the sub 213 and a ring part 224 on the catch sleeve 220. The catch sleeve 220 has lower collet type fingers 225 with external latch projections 226 for engaging the latching shoulder 135 (FIG. 10) in the release sleeve 118 of the packer. The spring member 222 normally biases the catch sleeve fingers 225 into engagement with a cone surface 228 on a mandrel part 230.

In moving downwardly through the bore 130, when the catch sleeve fingers engage the bore 130 of the packer, the catch sleeve fingers 225 and ring 224 are moved upwardly against the force of the spring member 222 to retract the catch sleeve fingers 225 toward a recess 232 on the lower mandrel 214 and enable passage through the bore of the packer. When the catch sleeve fingers reach the latching shoulder 135 in the release sleeve in the packer, the catch sleeve fingers spring outwardly into engagement with the latching shoulder 135 and are held outwardly by engagement with the shoulder 135 by subsequent engagement with the cone surface 228.

When the pulling tool is latched into the packer, a strain can be taken on the tubing string which is applied to the release sleeve 118 to release the packer mandrel 100 from the lower slip connector sleeve 112. When the sleeve 118 engages an internal shoulder 234 in the mandrel 100, the cone surface 211 on the pulling tool has brought the collet fingers 209 into engagement with the threads 102 on the packer mandrel. Further upward strain moves the central mandrel 100 of the packer upwardly to release the packer as described above.

In the event the packer is stuck, a shear pin release 237 is used to disable the retrieving tool and permit its retrieval.

THE SETTING TOOL

The setting tool assembly, as shown in FIG. 14A and 14B, includes a top sub 300 which is connected to a tubular central mandrel 302. The lower end of the central mandrel 302 connects to a setting tool mandrel 304 by a tubular coupling 305. The lower end of the setting tool mandrel 304 is threadedly coupled to a tubular central crossover mandrel 306 (FIG. 14B). In the upper end of the tool (FIG. 14A) are annular hydraulic pressure chambers 308*a* and 308*b* which are between the central mandrel 302 and tubular outer housing member 310. The housing member 310 is coaxially connected to the top sub 300 and the first upper hydraulic chamber 308*a* is defined between the central mandrel 302 and the inner wall of the outer housing member 310. The chamber 308*a* extends to a lower flange ring 311 on the outer member 310. A piston 313, which includes a piston head and tubular extension, is slidably mounted on the central mandrel 302 where the tubular extension 313*a* is slidable through the lower flange ring 311. The piston 313 is adapted to be initially positioned in an upper location, as shown in the drawing. In the upper chamber 308*a*, an access port 315 in the central mandrel 302 accesses hydraulic pressure from the interior of the tubing string to one side of the piston head 313*b* while the other side of the piston head 313*b* is accessed by a port 317 in the outer member 310 to the pressure in the annulus located exterior to the outer member 310. The tubular extension 313*a* has a shoulder 320 located along its length which limits the downward travel of the extension 313*a* relative to the lower flange ring 311.

Below the upper chamber 308*a* is another chamber 308*b* which similarly has a piston 322 with a tubular extension 322*a*. Hydraulic pressure of liquid is accessed from the interior of the central mandrel 302 through an access port 326 and the chamber 308*b* has a port 328 at its lower end to the exterior of the outer member 310.

A flange ring 329 in the outer member 310 slidably receives the tubular extension 322*a*. Below the flange ring 329 is another chamber 330. The lower chamber 330 is formed between the walls of the central mandrel 302 and the outer member 310 and contains a piston member 332. One side of the piston 332 is accessed to hydraulic pressure by a port 333 in the central mandrel 302. The other side of the piston 332 is accessed to the exterior of the tool by an access port 335. (FIG. 14B). The piston member 332 is threadedly attached to a tubular actuating sleeve 334 (FIG. 14B) which slidably extends over the tubular coupling 305. The tubular actuating sleeve 334 is also slidably received within the bore 336 of a tubular clutch sleeve 338. The clutch sleeve 338 is attached to the outer member 310.

The clutch sleeve 338 is provided with circumferentially spaced lug members 345 (lug connection 30 of FIG. 1) at its lower end which are adapted to co-rotatively engage with lug slots 342 in the upper end of the packer actuating sleeve 334 (See FIG. 7A). The clutch sleeve 338 has guide pins 340 which are located in longitudinal slots 347 in the actuating sleeve 334 to permit sliding but non-rotative relationship between the clutch sleeve 338 and the actuating sleeve 334.

The setting tool mandrel 304 which is attached by a coupling 305 to the lower end of the central mandrel 302 has an upper reduced diameter section 344 (See FIG. 15) forming an upwardly facing shoulder 346. A counterbored tubular release sleeve 348 is slidably and sealably received on the setting tool mandrel 304. An access port 350 in the setting tool mandrel 304 opens to a location between seals on the different diametered wall surfaces 344 and 352 on the mandrel 304. The differential pressure area permits pressure in the interior of the setting tool mandrel 304 to act through the port 350 to move the release sleeve 348 upwardly. The release sleeve 348 is releasable held in its initial condition by a shear pin 354. The release sleeve 348 also has a one-way ratchet mechanism 356 disposed in a recess for preventing return travel once the release sleeve 348 is moved upwardly. (See FIG. 15).

At the lower end of the release sleeve 348 (See FIG. 16) is a counterbore 358 and an intermediate recess 360 which form an upwardly facing internal shoulder 362. A collet finger support sleeve 364 has an upwardly extending tubular extension with a outwardly extending flange 366 where the flange 366 is disposed in the intermediate recess 360 so as to provide a spacing or lost motion interconnection of the collet finger support sleeve 364 relative to the release sleeve 348. The collet finger support sleeve 364 has longitudinal slots 367 circumferentially arranged to receive longitudinal guide lugs 368 on the central mandrel 304. The outer surface of the lower end of the collet finger support sleeve 364 has a stepped diameter portion forming an upper support surface 376*a* and a linear support surface 378*a*.

A collet finger connector 370 includes a ring section and depending collet fingers 372 which are disposed on the support sleeve 364 where the collet fingers 372 have external left handed threads 374 for engagement with the left handed threaded bore 102 of the packer. The collet fingers 372 have offset inner surfaces 376, 378 to respectively engage the surfaces 376*a*, 378*a* on the finger support sleeve 364.

In operation, internal hydraulic pressure in the tubing string acts through the access bore 350 (See FIG. 16) and moves the release sleeve 348 upwardly breaking the shear pin 354 (See FIG. 15). The lost motion permits momentum to be developed with respect to the collet finger support sleeve 364 to insure that the collet finger support sleeve 364 is moved upwardly and moves the underlying support surfaces 376*a*, 378*a* from supporting engagement with the undersurfaces 376, 378 of the collet fingers 372.

In operation of the setting tool, hydraulic pressure is developed to a first predetermined value in the string of tubing and acts through the access ports 315, 326, 333 on the pistons 313, 322, 332 (See FIG. 14) in the setting tool to move the setting sleeve 334 downwardly while the collet fingers 374 in the threaded bore 102 retain the packer fixed relative to the setting tool mandrel. The relative movement produces a downward motion of the setting tool actuating setting sleeve 334 on the packer and the packer is set and locked in position as described hereabove. At the same time the lugs 345 are disengaged from the packer.

To release the setting tool after the packer is set, hydraulic pressure at a higher pressure value than the hydraulic pressure required to set the packer acts through the access bores 350 (See FIGS. 15,16) to shear the pin 354 and actuate the release mechanism for the threaded collet members 374 to release from the packer bore 102. Thus, the threaded collet members 274 are hydraulically released from engagement with the packer.

CROSSOVER TOOL

Figure 18:
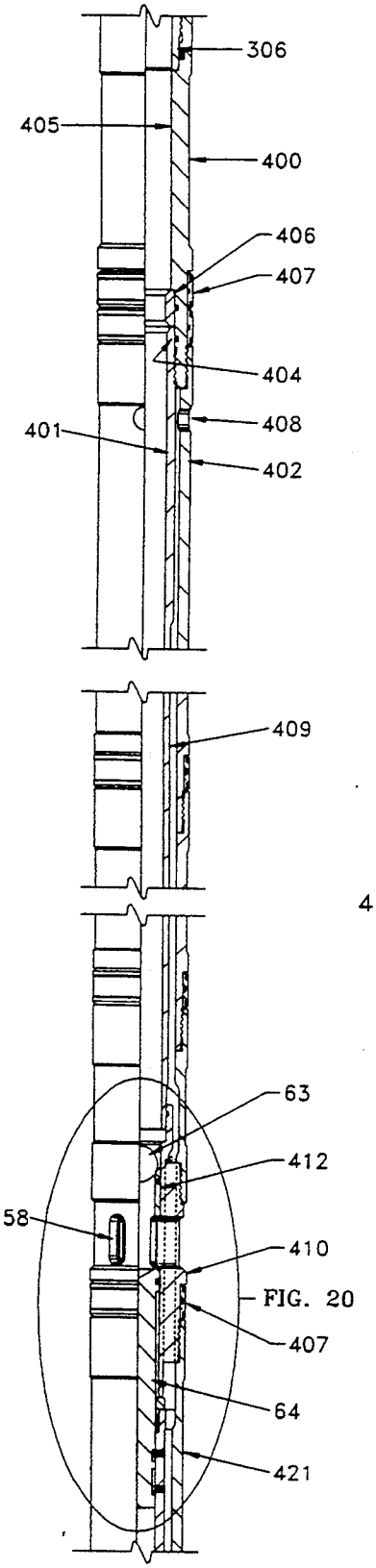
FIG. 18 is an illustration of the crossover tool assembly.

The crossover assembly, as shown in FIG. 18 of the drawings includes an upper seal sub 400 which is coupled to the setting tool mandrel 304. The lower end of the seal sub 400 connects to concentrically arranged tubular inner member 401 and tubular outer member 402. The inner member 406 has a central bore 404 smaller than the bore 405 of the seal sub 400 to define an upper ball seat 406. The seal sub 400 has external seal means 407 (Seal 50,52 in FIG. 1) disposed along its length at various location for sealing in the bore of the screen assembly. At the upper end of the outer member 402 is a bypass exit port 408 (port 80 in FIG. 4A) which is in fluid communication with an annular bypass passage 409 (annulus 78 in FIG. 5A) located between the inner member 401 and the outer member 402. The number of seal means 407 spaced longitudinally along the outer member 402 are as necessary to maintain a sealing continuity of the outer member 402 with respect to the seal bores in the screen assembly.

The lower ends of the inner member 401 and outer member 402 are connected to a crossover sub 410. The crossover sub 410 is tubular with a thick wall. Circumferentially spaced axial bypass passages 412 (passages 66 in FIG. 4B) extend through the length of the sub 410 (See FIGS. 20–22). Intermediate of the bypass passages 412 are radial gravel ports 414 (ports 58 in FIG. 3A) which extend from the central bore 415 of the sub 410 to the exterior wall 416 of the sub.

Figure 21:
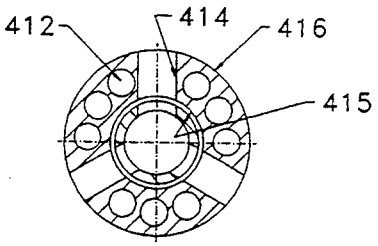
FIG. 21 is a view taken along line 21—21 of FIG. 20.
Figure 22:
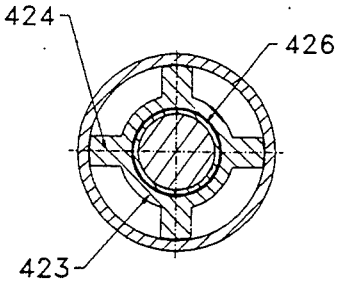
FIG. 22 is a view taken along line 22—22 of FIG. 20.
Figure 20:
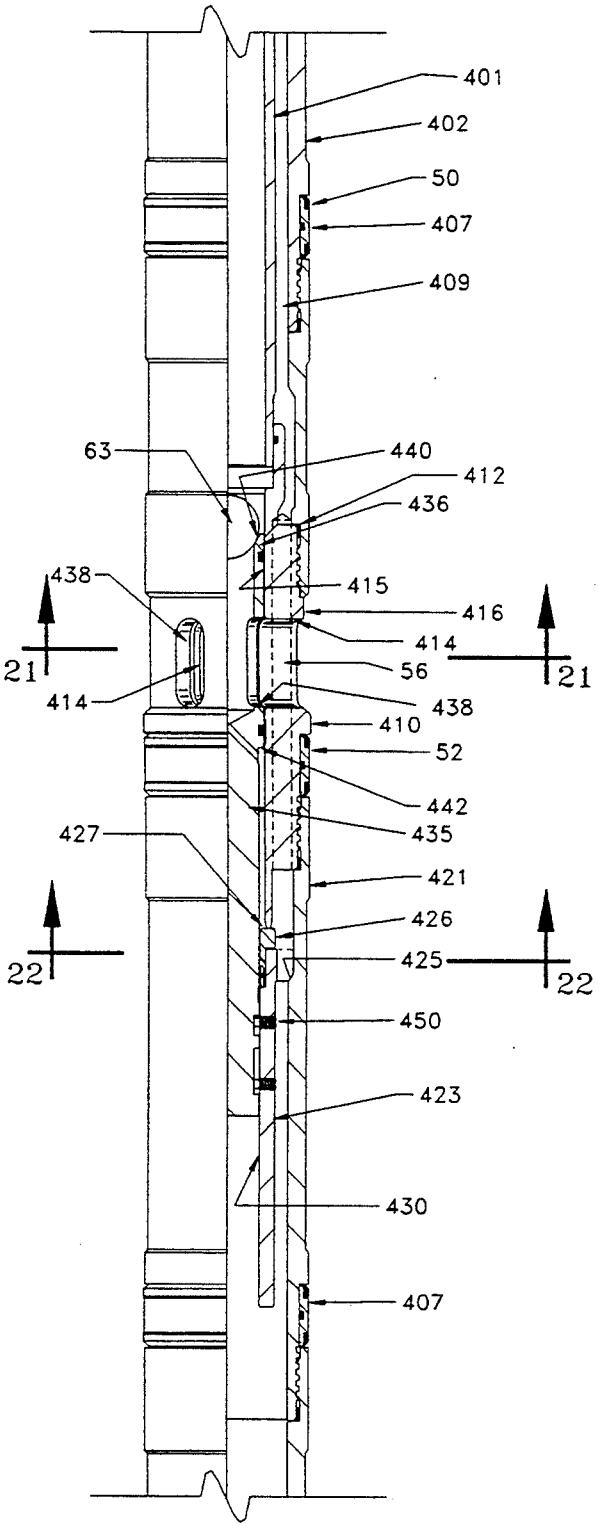
FIG. 20 is an enlarged view of a part of the tool shown in FIG. 18.

The crossover sub 410 is connected to a tubular lower outer member 421 (FIG. 20 and 21). The outer member 421 has seal means 407 disposed along its length which cooperate with the lower seal bore in the screen assembly for maintaining sealing continuity of the tool. An inner tubular member 423 has radial outwardly extended lugs 424 (See FIG. 22) which engage with an annular recess 425 in the outer member 421. An inner annular ring member 426 on the tubular member 423 defines an upwardly facing stop shoulder 427 above a smaller diameter bore 430 of the inner member 423.

The gravel port valve 435 (member 64 in FIG. 3A) is slidably received in the bore 430 of the inner member 423 and has flange 442 to limit downward travel to engagement with the stop shoulder 427. The valve 435 has a solid cross section located below an upper tubular section with radial ports 432 (ports 65 in FIG. 3A) where the ports align with the gravel ports 414 (ports 58 in FIG. 3A) in the crossover sub 416. The upper end of the tubular section forms a ball seat 440. A set of shear pins 450 retain the valve 435 in an open position.

Figure 24:
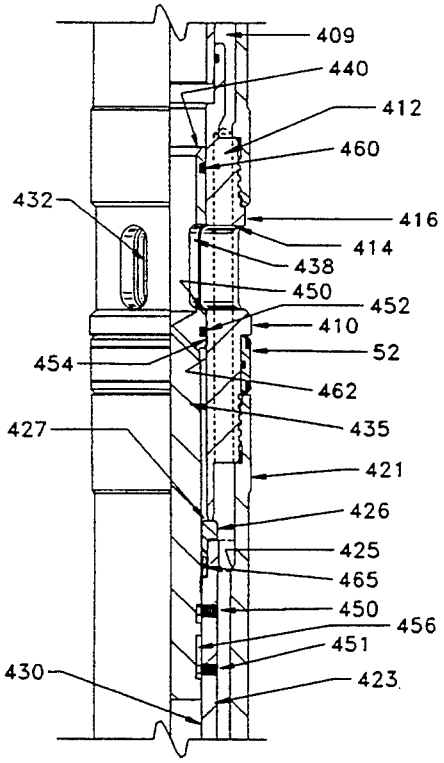
FIG. 24 is an enlarged view of the gravel valve of FIG. 20 which illustrates a bypass and safety feature of the present invention.

An important feature of the present invention is illustrated in the enlarged illustration in FIG. 24. To best understand this feature, it will be remembered that when the tool is made up at the earth's surface the volume below the seal 460 in the valve 435 is at atmospheric pressure. In going in the hole, liquid under hydrostatic pressure is admitted to the atmospheric volume below the seal 460 through the float valve FLV (see FIG. 3A). The volume below the seal 460 is sealed above the exit ports 80 (FIG. 3A) by a seal 80A. Heretofore, there has been no method or system to relieve the hydrostatic pressure in the tool should the tool be retrieved without setting the packer. As a result a high pressure chamber condition can exist if a tool is retrieved and can cause damage and injury at the earth's surface. In the present invention the crossover sub 410 is provided with a counterbore 450 which does not engage the seal 452 on the valve 435 so that there is a bypass passage 454 to the ports 414. Thus, hydrostatic pressure is bypassed through various unsealed surfaces and does not become trapped in the open position of the valve while going into the well bore. Should the tool be retrieved without actuation, hydrostatic pressure buildup is avoided.

To set the packer, a ball member 63 is seated on the seat 440 at an appropriate time to permit hydraulic actuation of the packer. Thereafter, a first higher pressure can be used to shear the pins 450 and permit downward movement of the plug member 435 relative to the inner member 423. Upon shearing of the pins 450, the valve 435 moves downwardly until the upper end of a slot 456 engages a set of shear pins 451. The shear pins 451 are sized to require a greater pressure than the setting pressure required to set the packer. When the slot 456 engages the shear pin 451, the seal 452 enters the bore 462 and traps hydrostatic pressure below the valve 435 while the packer is being set. This effectively maintains hydrostatic pressure below the packer even if the formation pressure drops and insures that the shear pins 160 (FIG. 7A) shear before the pins 451 shear. When the shear pins 160 are released, the setting tool is released and the pressure is equalized through the ports 80. As shown in FIG. 24, a one-way ratchet mechanism 465 prevents return of the valve 435 in an upward direction.

To open the valve 435, additional pressure is supplied to shear the pins 451 and move the ball valve seat 440 below the gravel ports.

THE INDICATOR

Figure 23:
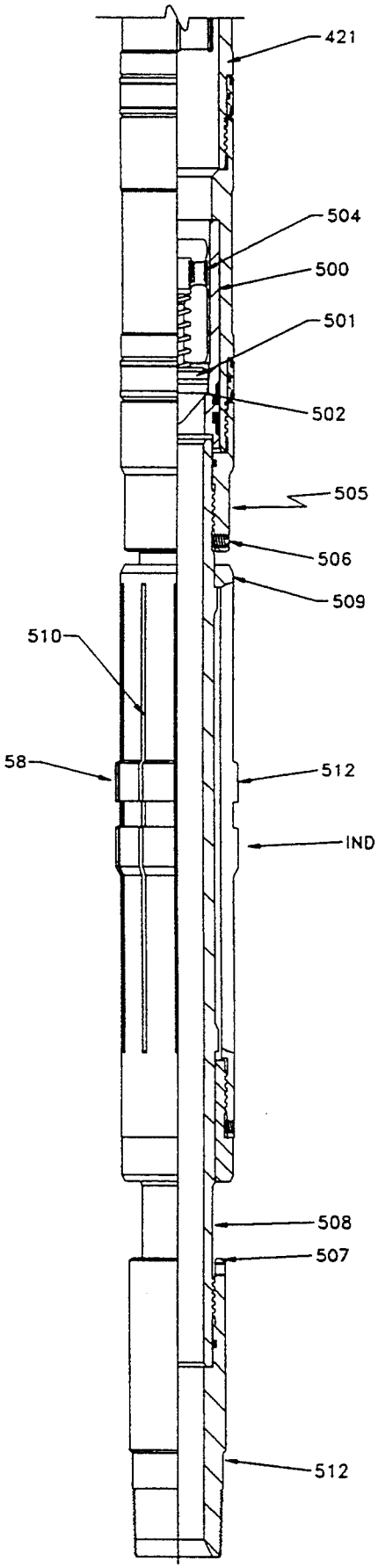
FIG. 23 is a view of the position indicator and float valve.

The lower end of the outer member of the crossover tool is coupled to a conventional float valve 500 (See FIG. 23). The float valve 500 is conventional in design and includes a spring biased valve member 501 which engages an upwardly facing valve seat 502. The valve has bypass ports 504 and permits fluid flow upwardly but not downwardly.

The float valve 500 is connected to a tubular indicator body 505 which has an upper flange 506 and a lower flange 507 and a central outer recess 508. A tubular collet indicator IND is formed from a tubular member 509 with longitudinally extending slots 510 and centrally located external flanges 512. The flanges 512 are, in effect, centrally located on flexible metal beams where the beams can be resiliently compressed upon entering a smaller bore diameter and resume their original configuration upon entering a larger bore diameter from a smaller bore section. The lower end of the body 505 has a tail pipe sub 512 which couples to a polished tail pipe (not shown in FIG. 23) which is slidably and sealingly receivable in a seal sub.

THE GRAVEL SCREEN VALVE

Figure 19:
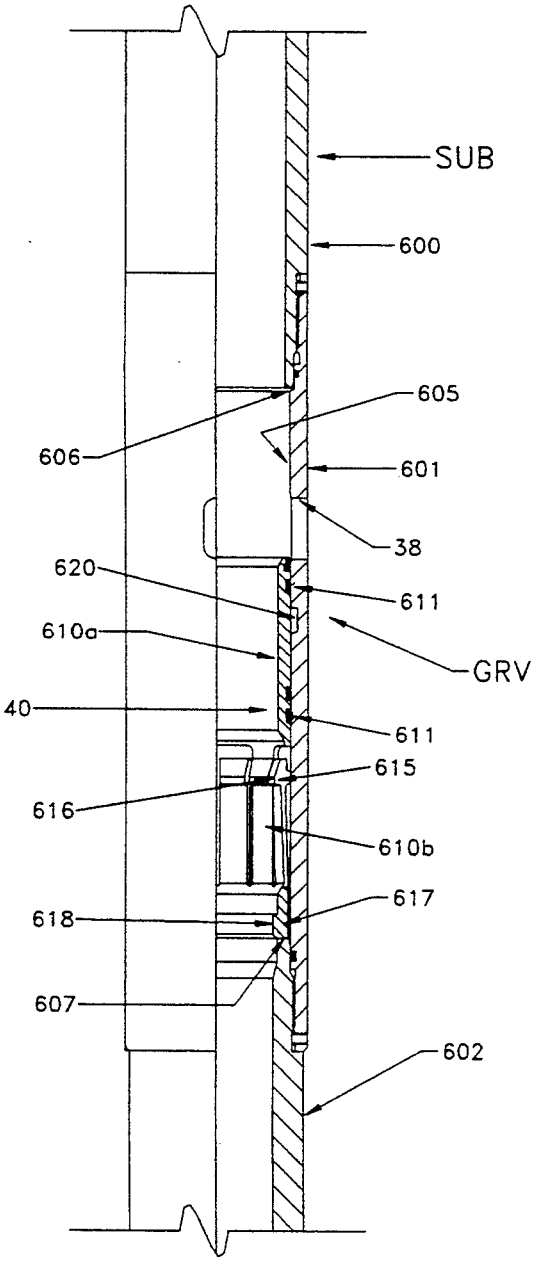
FIG. 19 is a view of a part of the gravel port valve in the screen assembly.

Referring now to FIG. 19, the gravel valve GRV includes interconnected pipe sections 600, 601 and 602 in the sub SUB. An internal annular recess 605 is formed between facing stop shoulders 606 and 607. A tubular slide valve member 610 (valve 40 in FIG. 2) is slidably mounted in the recess 605 and shown in an open position where the gravel ports 38 communicate the interior bore to the exterior of the tool while the valve member 610 is in a lower position and engages the stop shoulder 607.

The valve member 610 has an upper tubular section 610*a* with spaced apart seals 611 which straddle the ports 38 where the valve member is in an upper position. Below the tubular section 610*a* is windowed tubular member 610*b* which has collet type fingers 615 biased resiliently inwardly to define a bore diameter 616 less than the O.D. diameter of the flanges on the indicator IND. The collet fingers 615 are attached to a ring base 617 which has an internal shoulder 618 with a bore diameter less than the O.D. diameter of the flanges on the indicator IND. When the indicator IND is passed downwardly and engages the shoulder 618, the valve member 610 is moved to the position, as shown in the drawing. When the indicator IND is moved upwardly from a location below the valve member 610, it engages the shoulder 616 and moves the valve member 610 upwardly into engagement with the stop shoulder 606. At this time the fingers 615 are disposed adjacent to an annular recess 620 in the pipe section 601 and latch into the recess 620 and enlarge the diameter of the bore for the fingers. Thus, when the indicator IND is moved upwardly it engages the shoulder 616 to move the valve member 610 to an open position.

OPERATIONS

As described above, the system includes a hydraulic set packer with tubular gravel screen extensions and a hydraulic setting and crossover tool. It should be appreciated that the packer and screen assembly can be run in and set with a wireline tool with the crossover tool subsequently run in on a string of tubing.

The system as discussed above is designed to perform a gravel pack operation with a single trip of the string of tubing. The position indicator IND makes the system ideal for deep and deviated/horizontal wells in that the operator can determine the setting release and the movement required for the tool operations from surface indications. The tool operations are repeatable (as contrasted to one-shot) so that the operation can be repeatedly confirmed. No rotation is required to operate the tool; all operations are achieved through pressure and vertical movement. Rotation, however, can be safely used during transmission of the tool to the downhole location. The system has a backup for each of the operations of the service tool in the event a primary function should fail.

In the operation, the hydraulic set packer PKR and gravel screens SCR are run into the hole with the attached setting tool set and crossover tool XOV to the location depth. The bore of the tool and the gravel packer ports are open to bypass fluid while going in the hole. The sealing ball 63 is dropped when the packer reaches the proper depth and seats on the valve seat 64. The packer is then hydraulically set. The packer and tubing are then tested for leaks.

Figure 16:
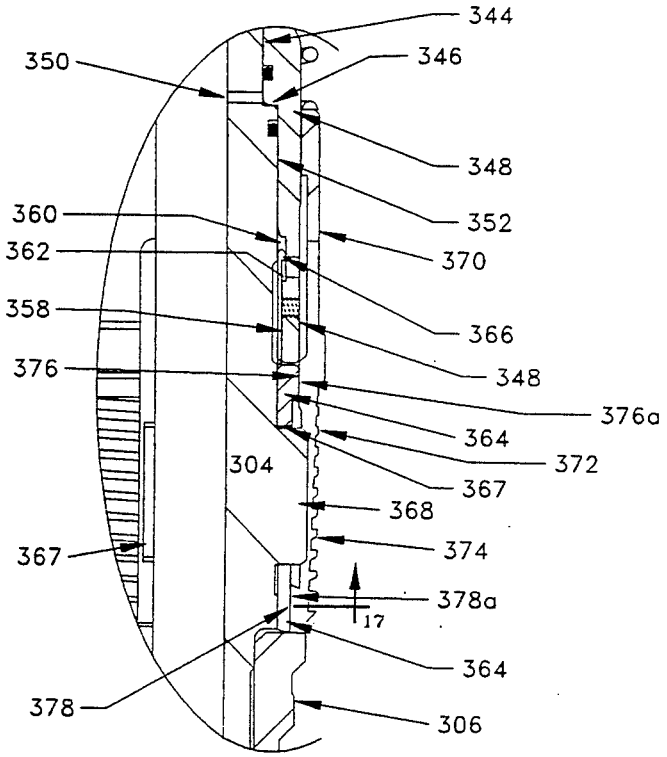
FIG. 16 is an enlargement view of a section of the tool shown in FIG. 15.

The setting tool is then operated by use of a higher second tubing pressure which hydraulically releases the setting tool from the packer (See FIG. 16).

Next, the crossover ports are opened with a higher third tubing pressure.

The gravel pack slurry is then pumped down the tubing string and crossed over to the screen/casing annulus below the setting tool. The gravel is packed into the annulus and perforated well bore. After completing the gravel pack, the excess gravel is reversed out and the setting tool retrieved leaving the packer in the hole as a retrievable production packer. A convention seal assembly (not shown) is run on a production tubing seals in the packer bore to complete the well.

The packer can be retrieved from the well bore by means of a retrieving tool.

Rotation is available as a backup system release mechanism. The setting tool and crossover tool are not sensitive to low bottom hole pressures and a check valve assembly 500 (FIG. 23) is run below the ball seat 440. The setting tool has a dual operated sealing ball valve. The primary system is to shift the sealing ball valve by applying tubing pressure. If this is not possible due to debris or tubing pressure ratings, the seating ball seat can be shifted by applying annulus pressure. This is accomplished by applying annulus pressure which will act upon the ball.

The setting tool and crossover tool are positioned by vertical tubing string movements. There are four positions; a squeeze position (FIG. 3A and 3B) where fluid is not returned to the surface, a lower circulation position (FIG. 4A and 4B) where fluid is returned through a lower screen only and an upper circulation position (FIG. 5A and 5B) where fluid returns through the main screens, and a reverse circulation position (FIG. 6A and 6B) where fluid flows from the annulus to the tubing string.

The indicator collar IND provides a positive weight indicator position of the crossover tool in the upper, lower and reverse circulating positions. The setting tool is mechanically interlocked to allow right-hand torque and rotation of the packer while going in the hole. The tool cannot accidentally be backed off of the packer. The mechanical interlock is disengaged during packer setting.

The assembly is initially set up by installing the setting tool and crossover assembly into the gravel pack packer with the left-hand thread 374 on the setting tool threadedly engaged with the matching thread 102 on the top sub 100*a* of the packer PKR. The screens SCR, SCR-1 and blank pipe (FIG. 2) are added to the assembly at the rig site. While running in the hole, fluid in the well bore is bypassed by the tubing string through the ports 38,56.

When the packer is at the selected depth in the well, an appropriate sealing ball 63 is dropped down the tubing and it lands on the ball seat 440 in the crossover valve (FIG. 20) providing a seal when pressure is applied to the string of tubing. As pressure in the tubing string increases relative to pressure in the well bore, the pistons 313, 323, and 332 in the setting tool produce a relative movement between the mandrel 100 of the packer and the actuating sleeve 158. The actuating sleeve 334 of the setting tool moves the actuating sleeve 158 of the packer. The load on the actuating sleeve 158 increases until the shear screws 150 connecting the actuating sleeve 158 and the top sub 100*a* shear. This action allows the outside tubular assembly of the packer assembly to be shifted relative to the mandrel 100. As the packer assembly moves down, the packer body lock ring 164 begins ratcheting down the mandrel 100*b*. The body lock ring 161 maintains/captures any downward displacement between the upper portion of the packer exterior and the mandrel. As the packer exterior continues to move down, the top of the upper slip cone 144 engages the slip elements 61 which are held in a retracted position by slip springs. The steep angle on the nose of the upper slip cone 144 forces all of the slips to become aligned and start moving up the ramp surface 137 of the lower slip cone 114 together. As the slip elements move down onto the lower slip cone 114 they are forced radially outward. The upper cone 144 continues down until the slip element 61 engage the casing. At this point, the load on the actuating sleeve 158 increases forcing the wickers of the slip elements to penetrate the wall of the casing and to apply a compressive load on the rubber elements 32. As the load increases, the length of the rubber elements 32 decreases and their diameter increases. This movement continues until the rubber elements 32 are tightly pressed against the wall of the casing.

To confirm the integrity of the packer setting, tension and compressive loads are applied to the tubing string, pressure is applied to the annulus above the packer to determine that the packer is anchored in the well bore and holds pressure.

If the primary sealing ball 63 leaks and will not hold pressure, a backup system is provided. A second ball (not shown) with a large diameter is dropped down the tubing and comes to rest on the secondary ball seat 406. These parts provide a backup seal for tubing setting pressure for the packer and release of the setting tool. The XOV Tool is attached to setting tool and all is accomplished in one trip.

After the packer has been set, the setting tool is released from the packer. There are two options to release the setting tool from the packer. The primary method of release is with tubing pressure. The secondary method is to mechanically rotate out of the packer.

The primary release is by applying pressure to the tubing so that the hydraulic release piston 348 (FIG. 15) is energized and loads the shear screws 354. When the tubing pressure reaches a predetermined value the shear screws 354 are sheared and allow the release piston 348 to move upwardly. As the release piston 348 moves upwardly it engages the support sleeve 364. As the release piston 348 continues to move upward it pulls the support sleeve 364 out from under the collet fingers 372 and releases the setting tool from the packer.

The secondary release is to mechanically rotate out of the packer. The tubing string tension is adjusted to a neutral point and right-hand torque is applied to the string of tubing to unscrew the left-hand lead thread which connects the collet fingers 372 packer top sub **100*b***. Approximately ten turns at the packer are required to release the setting tool from the packer.

It will be apparent to those skilled in the art that various changes may be made in the invention without departing from the spirit and scope thereof and therefore the invention is not limited by that which is disclosed in the drawings and specifications but only as indicated in the appended claims.

We claim:

1. A method for operating a hydraulically actuated packer and a connected tubular gravel packing screen tool in a wellbore containing a liquid at hydrostatic pressure comprising the steps of:

running the packer and the gravel packing screen tool into the wellbore with a string of tubing and an attached setting tool which is releasably connected to the packer and where the setting tool has an attached crossover tool within the gravel screen tool for providing liquid flow paths between the string of tubing and the crossover tool to the wellbore below the packer and to an upper annulus between the tubing and the wellbore above the packer and where the crossover tool includes an elongated bore section with a lower float valve, an upper axial gravel port and an intermediate valve member where the valve member has a ball valve seat above said axial gravel port and a fluid bypass extending from below said valve member to said gravel port so that liquid in the wellbore is not trapped between said float valve and said valve member;

at a desired location, closing said ball valve seat with a ball member and closing off said axial port;

applying a first pressure to said ball member to move said valve member to a first position and close off said bypass passage and to trap hydrostatic pressure below said bypass passage;

applying a second higher pressure to said ball member to hydraulically set said packer;

after said packer is set, applying a third higher pressure to said ball member to move said valve member to a second position where the axial port is opened.

2. The method as set forth in claim 1 and further including the step of retaining said valve member in said second position.

3. Apparatus for setting a hydraulically actuated packer and a connected tubular gravel packing screen tool in a wellbore containing a liquid at hydrostatic pressure comprising:

a hydraulically actuated packer and a gravel packing screen tool sized for passage through a wellbore;

a setting tool arranged for coupling to a string of tubing, said setting tool having means for providing a releasable connection to the packer;

a crossover tool connected to the setting tool and disposable in the gravel screen tool and having means for providing liquid flow paths between the string of tubing and the crossover tool to the wellbore below the packer and to an upper annulus between the string of tubing and the wellbore above the packer and where the crossover tool includes an elongated bore section containing a lower float valve, an upper axial gravel port and an intermediate valve member and where the valve member has a ball valve seat above said axial gravel port and selectively operable bypass means defining a normally open fluid bypass passage from below said valve member to said gravel port so that liquid in the wellbore is not trapped between said float valve and said valve member when said valve member is in a first position;

said ball valve seat being cooperable with a ball member for closing said elongated bore and for closing said axial port;

first releasable shear means for releasing said valve member and permitting movement to a second position in response to a first pressure to operate said bypass means to close off said bypass passage and to trap hydrostatic pressure below said bypass passage;

second releasable shear means for maintaining said valve member in said second position to permit said packer to be hydraulically set with a second higher pressure;

said second releasable shear means being responsive to a third higher pressure to move said valve member to a third position opening the axial port.

4. The apparatus as set forth in claim 3 wherein said bypass means includes a counterbore in said bore section and a seal member on said valve member.

5. The apparatus as set forth in claim 4 wherein said second releasable shear means is a shear pin in a slot on said valve member, said slot being arranged to stop movement of said valve member when said seal member is in said bore section and closes off said bypass means.

6. The apparatus as set forth in claim 5 and further including one-way ratchet means between said valve member and said bore section to prevent return movement of said valve member relative to said bore section.

7. A method for determining the downhole operation of a packer and a connected tubular gravel packing screen tool in a well bore comprising the steps of:

running the packer and the gravel packing screen tool into the well bore with a setting tool connected to the gravel packing screen tool where said gravel packing screen tool has upper, intermediate, and lower bore sections forming downwardly facing shoulders for deriving position indications and has an open valve between said upper and intermediate bore sections, and wherein said open valve has a closing sleeve with a bore section forming a shoulder for deriving a position indication and where said closing sleeve is located between said upper and said intermediate bore sections, and where an upper screen member is located between said intermediate and said lower bore sections and a lower screen member is located between said lower bore section;

at a desired location in the well bore, actuating the setting tool to set the packer in the well bore for anchoring said packer and said gravel screen tool in said well bore with the gravel screen tool and well bore defining a lower well annulus below said packer;

disposing a crossover tool on a string of tubing within the gravel screen tool for operating with said screen tool to selectively provide liquid flow paths between the string of tubing and the crossover tool to the lower well annulus between the screen tool and the well bore below the packer and to an upper well annulus between the string of tubing and the well bore above the packer;

said crossover tool having an elongated bore section which is closed off at an intermediate first location disposed below an axial gravel port and said bore section having a second longitudinal flow passage extending from a second location below said first location to an exit port at a third location positioned above said first location and further having a resilient indicator means located along its length, said resilient locator being sized relative to said upper, intermediate, and lower bore sections in said gravel screen tool so that such indicator means provides a surface indication at a predetermined force required to pass said indicator means through a bore section;

positioning said indicator means in a first position where said axial gravel port is in fluid communication from the string of tubing to said open valve and said lower well annulus and said lower screen is in fluid communication with said longitudinal flow passage and fluid can exit at the third location above said packer to the upper well annulus between the string of tubing and the well bore;

applying a pulling force to the string of tubing in excess of the predetermined force to move said indicator means from said first position to a second position and obtaining a surface indication that the crossover tool is positioned where said axial port is in fluid communication with said open valve and said upper screen member is in fluid communication with said longitudinal passage and fluid can exit at said third location above said packer to the upper well annulus between the string of tubing and the well bore;

applying a pulling force to the string of tubing in excess of the predetermined force to move the closing sleeve to close the open valve for obtaining a surface indication of the valve operation and to move said indicator means from said second position to a third position for obtaining a surface indication that the crossover tool is positioned where the axial port is in fluid communication with said upper well annulus;

slacking off on the string of tubing to apply a force in excess of said predetermined force to move said indicator means through said bore sections for moving said closing sleeve and for opening said valve and for obtaining a surface indication of passage of said indicator means through said bore sections and through said closing sleeve of said valve to return said indicator means to said first position.

8. The method as set forth in claim 2 and further including the steps of supplying a liquid mixture of gravel and liquid through said string of tubing while said indicator means is in said first position and depositing gravel in said lower well annulus while returning liquid to the earth's surface via the upper well annulus;

supplying a liquid mixture of gravel and liquid through said string of tubing while said indicator means is in said second position and depositing gravel in said lower well annulus between said lower and intermediate bore sections while returning liquid to the earth's surface via the upper well annulus;

supplying a control liquid through said upper well annulus while said indicator means is in said third position for reverse circulating of said mixture of gravel and liquid to the earth's surface via the string of tubing.

9. An apparatus for determining the downhole operation of a packer and connected tubular gravel packing screen tool in a well bore and including;

a packer and the gravel packing screen tool sized for reception in a well bore with the setting tool connected to the gravel packing screen tool;

said gravel packing screen tool having upper, intermediate, and lower bore sections forming downwardly facing shoulders for deriving position indications and having an open valve located between said upper and intermediate bore sections, an upper screen located between said intermediate and lower bore sections and a lower screen located below said lower bore section and where said valve includes a moveable sleeve member with a bore forming a shoulder for deriving a position indication, said sleeve member being moveable between first and second second positions and including means for releasably retaining said sleeve member in said first and second positions and requiring a predetermined force to move said sleeve member;

said packer having anchoring means and packing means for location in a well bore with the gravel screen tool and well bore for defining a lower well annulus below the packing means and for defining an upper well annulus above the packing means;

a crossover tool for use with a string of tubing and receivable within the gravel screen tool for operating with said gravel screen tool to selectively provide liquid flow paths between the string of tubing and the crossover tool to the lower well annulus between the screen tool and the well bore below the packer and to an upper well annulus between the string of tubing and the well bore above the packer;

said crossover tool having an elongated bore section which is closed off at an intermediate first location which is disposed below an axial gravel port and having a second longitudinal flow passage extending from a second location below said first location to an exit port at a third location positioned above said first location and further having a resilient indicator means along its length sized relative to said upper, intermediate, and lower bore sections in said gravel screen tool so that such indicator means provides a surface indication at a predetermined force required to pass said indicator means through a bore section;

said indicator means in a lower first position locating said axial gravel port in fluid communication with the string of tubing and said valve and said lower well annulus and placing said lower screen in fluid communication with said longitudinal flow passage so that fluid can exit at the third location above said packer element to the upper well annulus between the string of tubing and the well bore;

said indicator means requiring a pulling force on the string of tubing in excess of the predetermined force to move said indicator means from said first position to an intermediate second position and to obtain a surface indication that the crossover tool is positioned where said axial port is in fluid communication with said valve and said upper screen is in fluid communication with said longitudinal passage and fluid can exit at said third location above said packer to the upper well annulus between the string of tubing and the well bore and to move the sleeve member to close the valve with the predetermined force required to move said sleeve member and to move said indicator means from said second position to an upper third position and to obtain a surface indication that the crossover tool is positioned where the axial port can be in fluid communication with the said longitudinal passage and upper well annulus; and said indicator means being constructed and arranged for reciprocation of said cross-over tool from said upper position to said lower position to open the valve and reset the tool for operation.

10. The apparatus as set forth in claim 9 wherein said valve member further has resilient collet fingers being inwardly and outwardly moveable to cooperate with a locking recess in said tool in a closed position of said valve to retain the valve in a closed condition until said predetermined force for the sleeve member is exceeded.

11. The apparatus as set forth in claim 10 and further including float valve means in said crossover tool at a location below said axial port for limiting flow in one direction in said crossover tool below said axial port, said float valve means having a positive mechanical closing action for operation in deviated well bores.

12. An apparatus for use in a well bore and including:

a packer sized for reception in a well bore and having a central mandrel with a upper threaded portion with internal threads and an outer tubular assembly releasably connected to said central mandrel;

said packer having anchoring means and packer elements in said outer tubular assembly;

said setting tool having threaded interconnecting means for threaded interconnection with said upper threaded portion on said central mandrel where the threaded interconnecting means on said setting tool includes circumferentially arranged collet fingers with external threads engaging said upper threaded portion;

setting sleeve means slidably mounted on the central mandrel, said setting sleeve means including collet elements with supporting portions in engagement with the collet fingers for causing said external threads to engage said internal threads in a first position of said sleeve means;

said central mandrel having longitudinally extending guide legs in an interfitted relation ship with said collet fingers and said collet elements for providing a co-rotatable interconnection and;

means for causing said sleeve means to be hydraulically actuated for longitudinal displacement from the first position to a second position, said central mandrel having a recessed area to allow disengagement of said supporting portions of said collet elements from said collet fingers in said second position thereby to release the external threads from the internal threads.

13. The apparatus as set forth in claim 12 wherein said setting sleeve means has telescoping sleeve elements with spaced apart shoulders defining a lost motion connection where one of said sleeve elements is hydraulically actuated and the other of said sleeve elements is connected to said supporting portions.

14. The apparatus as set forth in claim 13 wherein one way lock means are disposed between said sleeve means and said central mandrel for preventing said sleeve means from moving from said second position to said first position.

15. The apparatus as set forth in claim 12 and including spring means engaging said collet fingers and said central mandrel for resiliently urging said collet fingers longitudinally of said central mandrel toward said first position.

16. The apparatus as set forth in claim 12 and further including end to end lug interlock means releasable interconnecting said setting tool and said packer for co-rotation while said setting tool is releasably connected to said packer, said interlock means being releasable upon setting of said packer for permitting relative rotation between said packer and said setting tool.

17. Apparatus as set forth in claim 16 and including a gravel packing screen tool connected to said packer and a crossover assembly connected to said central mandrel, said crossover assembly having means for providing liquid flow paths between a string of tubing and the crossover assembly to the wellbore below the packer and to an upper annulus between the string of tubing and the well bore above the packer and where the crossover assembly includes an elongated bore section containing a lower float valve, an upper axial gravel port and an intermediate valve member and where the valve member has a ball valve seat above said axial gravel port and selectively operable bypass means defining normally open fluid bypass passage from below said valve member to said gravel port so that liquid in the well bore is not trapped between said float valve and said valve member when said valve member is in a first position;

said ball member being cooperable with a ball member for closing said elongated bore and for closing said axial port;

first releasable shear means for releasing said valve member and permitting movement to a second position in response to a first pressure to operate said bypass means to close off said bypass passage and to trap hydrostatic pressure below said bypass passage;

second releasable shear means for maintaining said valve member in said second position to permit said packer to be hydraulically set with a second higher pressure;

said second releasable shear means being responsive to a third higher pressure to move said valve member to a third position opening the axial port.

18. The apparatus as set forth in claim 17 wherein said bypass means includes a counterbore in said bore section and a seal member on said valve member.

19. The apparatus as set forth in claim 18 wherein said second releasable shear means is a shear pin in a slot on said valve member, said slot being arranged to stop movement of said valve member when said seal member is in said bore section and closes off said bypass means.

20. The apparatus as set forth in claim 19 and further including one-way ratchet means between said valve member and said bore section to prevent return movement of said valve member relative to said bore section.

21. The apparatus as set forth in claim 20 wherein said gravel packing screen tool has upper, intermediate, and lower bore sections forming downwardly facing shoulders for deriving position indications and having an screen gravel port located between said upper and intermediate bore sections, an upper screen located between said intermediate and lower bore sections and a lower screen located below said lower bore section and where said tool has a moveable sleeve member associated with said screen gravel port to define a screen gravel port valve, and sleeve member having a bore forming a shoulder for deriving a position indication, said sleeve member being moveable between first and second positions and including means for releasably retaining said sleeve member in said first and second positions and requiring a predetermined force to move said sleeve member;

said packer elements defining a lower well annulus below the packer and an upper well annulus above the packer;

said crossover assembly further having a resilient indicator means along its length sized relative to said upper, intermediate, and lower bore sections in said gravel screen tool so that said indicator means provides a surface indication at a predetermined force required to pass said indicator means through a bore section;

said indicator means in a lower first position location said axial gravel port in fluid communication with the string of tubing and said screen gravel port valve and said lower well annulus and placing said lower screen in fluid communication with said longitudinal flow passage so that fluid can exit at the third location above said packer element to the upper well annulus between the string of tubing and the well bore;

said indicator means requiring a pulling force on the string of tubing in excess of the predetermined force to move said indicator means from said first position to an intermediate second position and to obtain a surface indication that the crossover assembly is positioned where said axial port is in fluid communication with said screen gravel port valve and said upper screen is in fluid communication with said longitudinal passage and fluid can exit at said third location above said packer to the upper well annulus between the string of tubing and the well bore and to move the sleeve member to close the screen gravel port valve with the predetermined force required to move said sleeve member and to move said indicator means from said second position to an upper third position and to obtain a surface indication that the crossover assembly is positioned where the axial port can be in fluid communication with the said longitudinal passage and upper well annulus; and said indicator means being constructed and arranged for reciprocation of said cross-over tool from said upper position to said lower position to open the screen gravel port valve and reset the tool for operation.

22. The apparatus as set forth in claim 21 wherein said valve member further has resilient collet fingers being inwardly and outwardly moveable to cooperate with a locking recess in said tool in a closed position of said screen gravel port valve to retain the screen gravel port valve in a closed condition until said predetermined force for the sleeve member is exceeded.

23. The apparatus as set forth in claim 12 wherein said packer includes:

tubular actuating means slidably disposed on said central mandrel, said actuating means having a depending tubular support sleeve;

packing elements disposed on said tubular support sleeve for movement between a retracted position and an radially extended position in sealing engagement with a well bore;

said anchoring means on said central mandrel being moveable between a retracted position on an extended position in gripping engagement with the well bore;

releasable collar means releasably connected to said central mandrel below said anchoring means;

first means for releasably coupling said upper tubular actuating means to said central mandrel in a first position where said packing elements and said anchoring means are in retracted conditions and releasable to permit said anchoring means to move to extended positions and to permit said packing elements to move to the expanded position.

second means for releasably coupling said tubular actuating means to said central mandrel in a second position where said packing elements and said anchoring means are in extended positions;

releasable connecting means for interconnecting said relesable collar means to said central mandrel, said releasable connecting means including rigid locking members disposed in openings in said central mandrel where said locking members have external locking surfaces in engagement with said releasable collar means and including a tubular retainer sleeve in the bore of said central mandrel for retaining said lock members in engagement with said releasable collar means;

said retainer sleeve being longitudinally movable to release said locking members from said releasable collar means to permit movement of said lower releasable collar means relative to said central mandrel for moving said anchor means to a retracted position and said packing elements from an extended position to a retracted position.

24. The apparatus as set forth in claim 23 wherein said external locking surfaces are threads and said locking members have spaced part inner support elements separated by a groove, said retainer sleeve having spaced apart recesses for receiving said support elements upon longitudinal movement of said retainer sleeve.

25. The apparatus as set forth in claim 24 and further including release pin means releasably interconnecting said retainer sleeve to said central mandrel.

26. The apparatus as set forth in claim 23 including means for co-relatively coupling said tubular actuating means and said anchoring means to said central mandrel.

27. The apparatus as set forth in claim 23 wherein said second means includes a resilient ratchet member disposed between a first threaded engagement with the central mandrel and a second threaded engagement with the tubular support sleeve, said central mandrel having an upwardly facing shoulder arranged to engage said support sleeve for release of said second means upon retrieval of the packer.

28. An apparatus for use in a well bore and including:

a packer and the gravel packing screen tool sized for reception in a well bore;

a setting tool connected to a string of tubing and releasably connected to the packer and the gravel packing screen tool;

said gravel packing screen tool having upper, intermediate, and lower bore sections and having normally open valve means located between said upper and intermediate bore sections, an upper screen located between said intermediate and lower bore sections and a lower screen located below said lower bore section;

said packer having anchoring means and packer elements for location in a well bore with the gravel screen tool and well bore defining a lower well annulus below the packing means;

said setting tool including crossover tool receivable within the gravel packing screen tool for operating with said gravel packing screen tool to selectively provide liquid flow paths between the string of tubing and the crossover tool to the lower well annulus between the screen tool and the well bore below the packer and to an upper well annulus between the string of tubing and the well bore above the packer;

said crossover tool having an elongated bore section which can be closed off at an intermediate first location which is disposed below an axial gravel' port and having a second longitudinal flow passage extending from a second location below said first location to an exit port at a third location positioned above said first location;

said setting tool and said packer having releasable threaded interconnecting means where the threaded means on said setting tool includes external threaded collet fingers overlaid on a release sleeve means and where the sleeve means is slidable on a central mandrel, said sleeve means being hydraulically actuated for displacement from a supporting relationship to said collet fingers to allow disengagement of said collet fingers from said packer;

said setting tool having lug means for arranged in an end to end relationship with interlocking lug means on said packer for co-rotation of said setting tool and said packer, said setting tool lug means being releasable from said packer lug means upon setting of said packer for permitting relative rotation between the packer and the setting tool after the packer is set in the well bore.

29. The apparatus as set forth in claim 28 wherein said setting sleeve means has telescoping sleeve elements with spaced apart shoulders defining a lost motion connection where one of said sleeve elements is hydraulically actuated and the other of said sleeve elements is connected to said supporting portions.

30. The apparatus as set forth in claim 29 wherein one way lock means are disposed between said sleeve means and said central mandrel for preventing said sleeve means from moving from said second position to said first position.

31. The apparatus as set forth in claim 28 and including spring means engaging said collet fingers and said central mandrel for resiliently urging said collet fingers longitudinally of said central mandrel toward said first position.

32. A method for gravel packing a well bore utilizing a hydraulically actuated packer and a connected tubular gravel packing screen tool in a well bore comprising the steps of:

running the packer and the gravel packing screen tool into the well bore with a setting tool releasably connected to the gravel packing screen tool by a hydraulically actuated setting tool mechanism where said gravel packing screen tool has upper, intermediate, and lower bore sections forming downwardly facing shoulders for deriving position indications and has an open valve between said upper and intermediate bore sections, and wherein said open valve has a closing sleeve with a bore section forming a shoulder for deriving a position indication and where said closing sleeve is located between said upper and said intermediate bore sections, and where an upper screen member is located between said intermediate and said lower bore sections and a lower screen member is located between said lower bore section and where a crossover tool on the string of tubing is disposed within the gravel screen tool for operating with said screen tool to selectively provide liquid flow paths between the string of tubing and the crossover tool to the lower well annulus between the screen tool and the well bore below the packer and to an upper well annulus between the string of tubing and the well bore above the packer, and where the crossover tool has a gravel port initially closed off by a ball seating member;

at a desired location in the well bore, dropping a seating ball to said ball seating member and at a first hydraulic pressure setting and anchoring the packer in the well bore, then with a second higher hydraulic pressure actuating the setting tool release mechanism to release the setting tool from the packer; said packer and said gravel screen tool in said well bore defining a lower well annulus below said packer; upon setting and anchoring the packer, applying a third hydraulic pressure for releasing said ball seating member and for opening said gravel port;

said crossover tool having a resilient indicator means located along its length, said resilient locator being sized relative to said upper, intermediate, and lower bore sections in said gravel screen tool so that such indicator means provides a surface indication at a predetermined force required to pass said indicator means through a bore section;

positioning said indicator means in a first position where said gravel port is in fluid communication from the string of tubing to said open valve and said lower well annulus and said lower screen is in fluid communication with said longitudinal flow passage and fluid can exit at the third location above said packer to the upper well annulus between the string of tubing and the well bore;

applying a pulling force to the string of tubing in excess of the predetermined force to move said indicator means from said first position to a second position and obtaining a surface indication that the crossover tool is positioned where said axial port is in fluid communication with said open valve and said upper screen member is in fluid communication communication with said open valve and said upper screen member is in fluid communication with said longitudinal passage and fluid can exit at said third location above said packer to the upper well annulus between the string of tubing and the well bore;

applying a pulling force to the string of tubing in excess of the predetermined force to move the closing sleeve to close the open valve for obtaining a surface indication of the valve operation and to move said indicator means from said second position to a third position for obtaining a surface indication that the crossover tool is positioned where the axial port is in fluid communication with said upper well annulus;

slacking off on the string of tubing to apply a force in excess of said predetermined force to move said indicator means through said bore sections for moving said closing sleeve and for opening said valve and for obtaining a surface indication of passage of said indicator means through said bore sections and through said closing sleeve of said valve to return said indicator means to said first position.

33. The method as set forth in claim 32 and further including the steps of supplying a liquid mixture of gravel and liquid through said string of tubing while said indicator means is in said first position and depositing gravel in said lower well annulus while returning liquid to the earth's surface via the upper well annulus;

supplying a liquid mixture of gravel and liquid through said string of tubing while said indicator means is in said second position and depositing gravel in said lower well annulus between said lower and intermediate bore sections while returning liquid to the earth's surface via the upper well annulus;

supplying a control liquid through said upper well annulus while said indicator means is in said third position for reverse circulating of said mixture of gravel and liquid to the earth's surface via the string of tubing.

* * * * *